United States Patent [19]

Gruber et al.

[11] 4,395,031

[45] Jul. 26, 1983

[54] APPARATUS FOR PRINTING BOOKS OF SIGNATURES AND METHOD FOR SAME

[75] Inventors: Damie C. Gruber, St. Paul; Bernard J. Robichaud, Roseville, both of Minn.

[73] Assignee: The Webb Company, St. Paul, Minn.

[21] Appl. No.: 300,304

[22] Filed: Sep. 8, 1981

[51] Int. Cl.[3] ..... B65H 39/02

[52] U.S. Cl. ..... 270/54; 270/55

[58] Field of Search ..... 270/53–58

[56] References Cited

U.S. PATENT DOCUMENTS

| | | | |
|---|---|---|---|
| Re. 29219 | 10/1974 | Taylor et al. . | |
| 3,169,762 | 2/1965 | Parks . | |
| 3,527,455 | 9/1970 | Reist . | |
| 3,661,379 | 5/1972 | Dolfini . | |
| 3,689,693 | 9/1972 | Cahill et al. . | |
| 3,692,301 | 9/1972 | Wetter . | |
| 3,813,093 | 5/1974 | Taupin . | |
| 3,819,173 | 6/1974 | Anderson et al. . | |
| 3,899,165 | 8/1975 | Abram et al. . | |
| 3,902,708 | 9/1975 | Wise et al. . | |
| 3,917,252 | 11/1975 | Harder et al. . | |
| 3,924,845 | 12/1975 | Wise et al. . | |
| 3,953,017 | 4/1976 | Wise . | |
| 3,966,185 | 6/1976 | McCain | 270/53 X |
| 3,982,744 | 9/1976 | Kraynak et al. . | |
| 4,022,455 | 5/1977 | Newsome et al. . | |
| 4,106,061 | 8/1978 | Burnett . | |
| 4,112,469 | 9/1978 | Paranjpe et al. . | |
| 4,121,818 | 10/1978 | Riley et al. . | |
| 4,133,521 | 1/1979 | Muller . | |
| 4,168,828 | 9/1979 | McLear . | |
| 4,171,127 | 10/1979 | Kish et al. . | |
| 4,174,829 | 11/1979 | McCain et al. . | |
| 4,179,110 | 12/1979 | Kosugi et al. . | |
| 4,225,872 | 9/1980 | Marinoff . | |
| 4,241,908 | 12/1980 | Marcus . | |
| 4,245,225 | 1/1981 | Fillmore et al. . | |
| 4,259,696 | 3/1981 | Paranjpe et al. . | |

*Primary Examiner*—A. J. Heinz

*Attorney, Agent, or Firm*—Merchant, Gould, Smith, Edell, Welter & Schmidt

[57] ABSTRACT

The present invention relates to a system and method for printing signature books (29). The system includes a plurality of feeders (10) for delivering signatures (30) to a conveyor (12) so as to progressively build up books of signatures (29). The apparatus further includes a signature printing station (16) located downstream of the feeder means (10) and adjacent plate-like members (48) for printing substantially simultaneously on two or more pages (31, 33), such as a cover (33), and an inside page (31), of a book of signatures (29).

The method of the present invention includes the steps of delivering the signatures (30) onto a moving conveyor (12) from a plurality of feeders (10) and conveying the signatures (30) in a downstream direction so as to progressively build up books of signatures (29). The method further includes the steps of selecting a signature (30) from one of the feeders (10), opening each book of signatures at the selected signature (30), and substantially simultaneously printing information on two or more pages (31, 33), such as a cover page (33) and an inside page (31), of a book of signatures (29).

23 Claims, 28 Drawing Figures

APPARATUS FOR PRINTING BOOKS OF SIGNATURES AND METHOD FOR SAME

TECHNICAL FIELD OF THE INVENTION

The present invention relates to an apparatus and method for printing books of signatures. More particularly, the present invention relates to an apparatus and method for printing substantially simultaneously on two or more pages, such as an inside page and a cover page, of a book of signatures, thereby assuring the proper correlation of subscriber customized information printed on the inside page of a book of signatures with the subscriber mailing label information printed on the cover page of the book of signatures.

BACKGROUND OF THE INVENTION

Collating and binding systems for producing books of signatures are well-known in the prior art. A book of signatures, as conventionally defined in the art, is any collection or grouping of one or more signatures. More commonly, books or collections of signatures are referred to by the general public as magazines, catalogs, periodicals, directories, etc.

There is an increasing desire in the signature printing art to be able to mail books of signatures containing customized information to subscribers. Subscribers of various types of journals, periodicals, catalogs, directories, books, pamphlets, etc., represent different markets as they live in different geographical areas and have different wants and needs. Therefore, certain information is more relevant to some than to others. Those in the printing industry face the problem of providing this customized information in an efficient and accurate manner.

Methods and apparatus for producing books or collections of signatures containing customized information are known in the signature printing art. However, it is difficult to assure that the customized information printed on the inside pages of the books of signatures corresponds to the subscriber mailing label information printed on the cover pages of the books of signatures.

U.S. Pat. No. 4,121,818 (Reilly et al.) is representative of a system for producing books of signatures containing customized information. In Reilly et al., a dot-matrix printer is positioned adjacent a conveyor intermediate of the feeders which feed signatures onto the conveyor progressively building books of signatures. A computerized control system determines the customized information to be printed on the signatures and controls the printing of signatures by the dot-matrix printer. A caliper device located downstream of the dot-matrix printer determines whether or not any pages are missing from a book of signatures. A second dot-matrix printer, located downstream of the first signature printer and of the caliper, prints mailing labels on the books of signatures under control of the computerized control system.

The Reilly et al. signature printing system has several undesirable features. Books of signatures found by the caliper device to have pages missing are reprinted. This causes excessive printing of pages as the faulty books have already had customized information printed in them. In addition, since the rejection of faulty books occurs after the printing of customized information and before the printing of mailing label information, the computerized control system must maintain a rather complicated indexing and information correlation scheme in order to assure that the mailing label printed on a book of signatures at the second printer station corresponds to the customized information printed in that book of signatures at the first printer station.

In Reilly et al. the signature printers are capable of only printing on the outside pages of the signatures as they straddle the conveyor and not on the centerfold pages, which necessitates the dot-matrix printer being located intermediate of the feeder devices when it is desired to print customized information on the inside page of a book of signatures. If multiple pages of customized information in a book of signatures are to be printed, the Reilly et al. system requires that multiple printing stations be established along the conveyor line intermediate of the feeders so that multiple outside pages of signatures can be printed.

The Reilly et al. system also does not appear to make allowance for loss of books of signatures through causes other than missing pages. Thus, it is possible that missing books due to some other cause might go undetected and undelivered to their subscribers.

SUMMARY OF THE PRESENT INVENTION

The present invention relates to a signature printing system for collating and printing signatures to form books of signatures having customized information printed on the inside thereof. The present invention includes a collating conveyor for receiving signatures delivered thereon by a plurality of feeders at longitudinally spaced stations adjacent the collating conveyor so as to progressively build up books of signatures. The conveyor conveys the signatures in a generally downstream direction. A means is located adjacent the conveyor and extends downstream from the feeders for selecting a signature from one of the feeders. Downstream of the selection means is an opening means for opening each book of signatures at the selected signature. A signature printing means located adjacent the opening means prints information on an inside page of the book of signatures when opened by the opening means.

The present invention also relates to a signature printing method for collating and printing signatures to form books of signatures having customized information printed on the inside thereof. The signature printing method includes the steps of delivering the signatures onto a collating conveyor from a plurality of feeders at longitudinally spaced stations adjacent said collating conveyor and conveying the signature in a downstream direction so as to progressively build up books of signatures as signatures are delivered onto the collating conveyor. The signature printing method further includes the steps of selecting a signature from one of the feeders, opening each book of signatures at the selected signature, and printing information on an inside page of each book of signatures.

In a preferred embodiment, the present invention is illustrated as having a collating conveyor chain with a plurality of signature feeders depositing signatures over the conveyor chain such that the signatures straddle the conveyor chain at their binding, the conveyor moving the signatures in a downstream direction. A wire extends adjacent the conveyor chain upstream from a plate-like member located downstream from the feeders to a location adjacent one of the feeders such that signatures delivered therefrom and from feeders downstream therefrom are delivered over the wire. Signature printing is accomplished at a printing station having dot matrix printers mounted adjacent the plate-like member. The plate-like member is positioned adjacent the conveyor chain and cooperates with the conveyor chain to open and position the pages for printing on by the dot matrix printers. A caliper is located adjacent the conveyor and upstream of the signature printer to detect books of signatures which contain an improper number of pages. An audit cell is located downstream of all stations to detect the presence or absence of a book of signatures prior to stacking for mailing.

The entire system is controlled by a computerized control system. The computerized control system determines the information to be printed on the pages and coordinates the various functions and activities of the system.

The printing system utilizes a leading edge detector just upstream of the printing station to detect the leading edge of a book of signatures as the book of signatures approaches the printers. An encoder attached to the conveyor chain drive mechanism is then utilized to determine how far the book of signatures has advanced for character indexing and character spacing purposes, thereby assuring even spacing and proper indexing even though the conveyor speeds may vary. As a result, very precise and neat character printing is achieved.

The present invention enables the substantially simultaneous printing of two or more pages, such as the inside and cover pages, of books of signatures. This enables the label and customized information to be printed at the same time, thereby assuring proper correlation of subscriber label and customized information. In addition, multiple printer stations spaced intermediate of the feeders are not required if customized printing is to be performed on more than one inside page.

The signature printing system prohibits printing of books of signatures found by the caliper to contain an improper number of pages and provides for the next sequential book of signatures of proper size to be printed on. Thus, excessive and wasteful reprinting of books of signatures is avoided. Of even more importance is the fact that the system does not have to utilize a great deal of overhead processing to maintain the coordination between the printing activities of label printing and customized information printing when a book of signatures is faulty, as both of these printing functions are accomplished at approximately the same time and printing station. A much simplified computerized control system can therefore handle the needs of the present invention as the control system does not have to keep track of customized and mailing label information being printed at different locations in the signature printing system and at different times during the signature printing process.

The present invention is capable of detecting and automatically reprinting books of signatures lost through reasons other than having an improper number of pages, such as being removed after being cut up by the trimmer, thereby assuring every subscriber receives a book of signatures with customized information.

The printing system further provides a system of alarms for notifying the system personnel of certain key events and marks the book of signatures when there is a mail distribution change, which assists in the proper stacking of books of signatures for mailing.

These and various other advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there is illustrated and described a preferred embodiment of the invention.

BRIEF DESCRIPTION OF THE DRAWING

In the drawing, in which like reference numerals and letters indicate corresponding parts throughout the several views.

DETAILED DESCRIPTION OF THE INVENTION (For purposes of this specification, the conveyor chain 12 will be referred to as moving signatures 30 in a downstream direction. The opposite direction will be referred to as upstream.)

Figure 1:
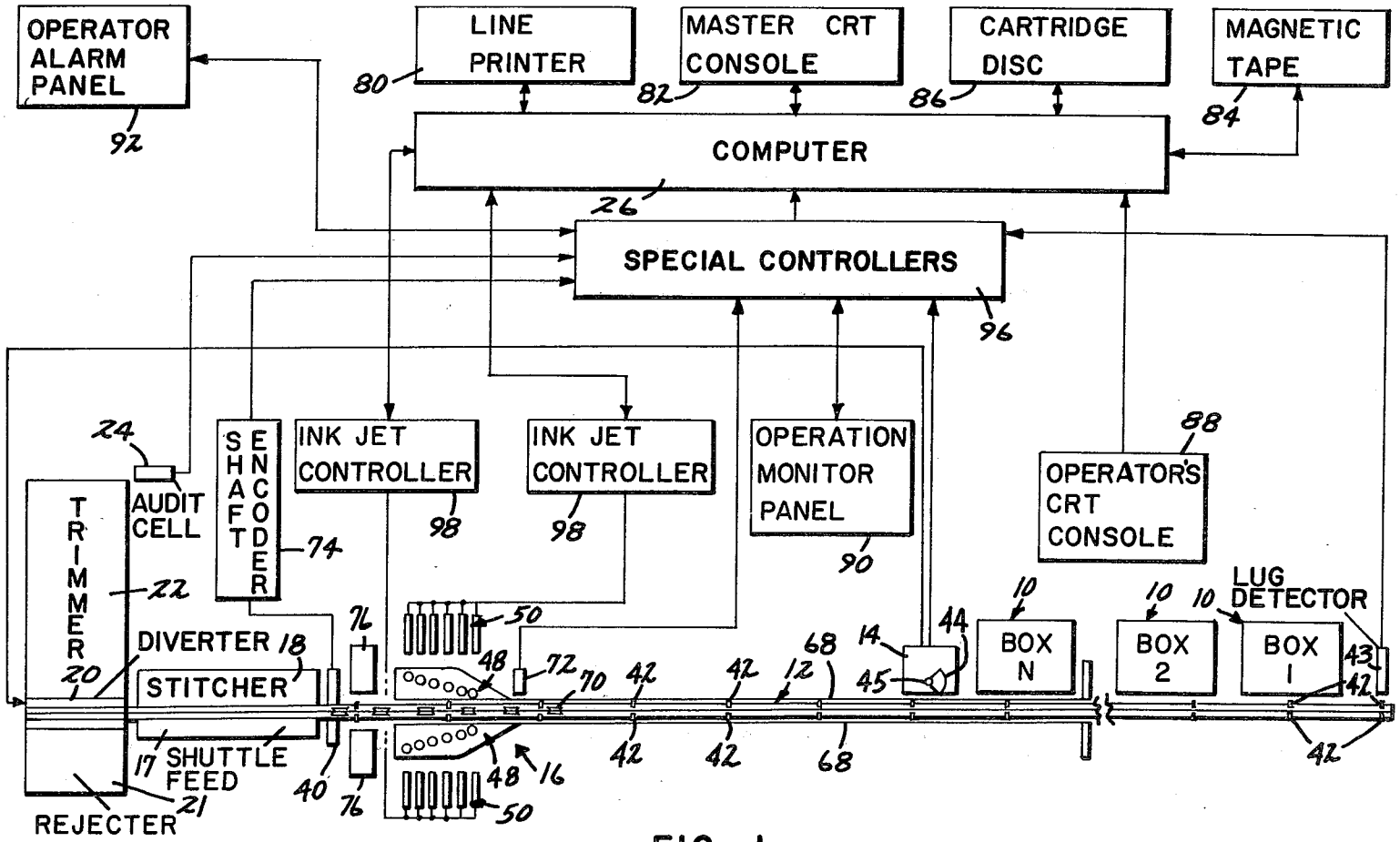
FIG. 1 is a block diagram of a signature printing system utilizing side-by-side mounting of plate-like members.
Figure 12:
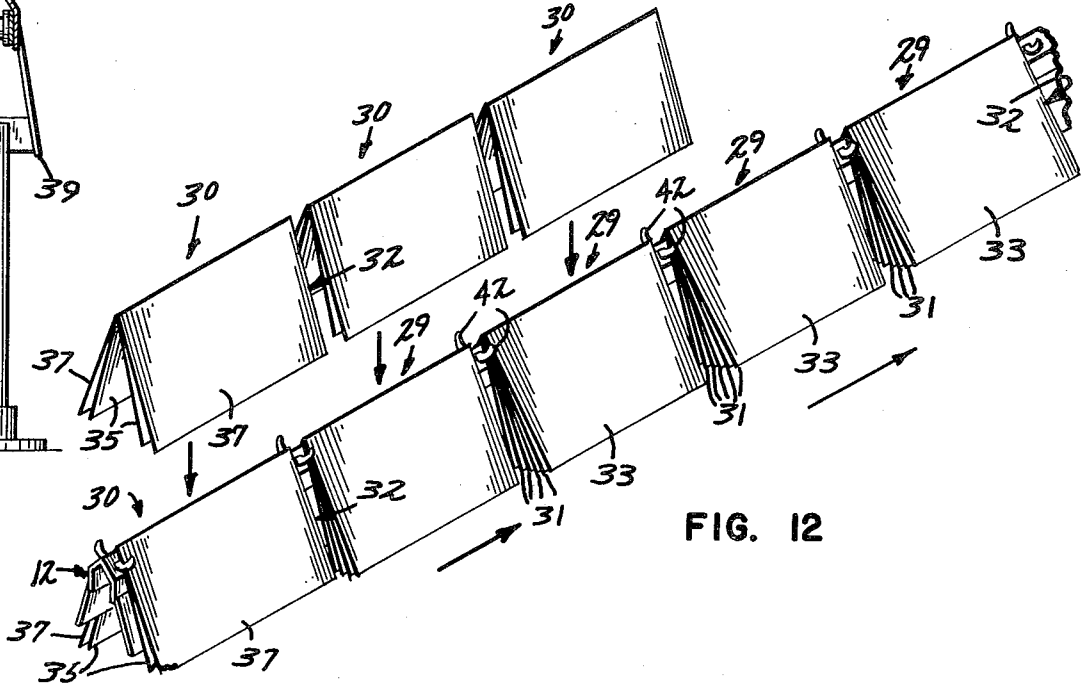
FIG. 12 is a perspective view of a plurality of signatures being progressively delivered on top of each other to form collections or books of signatures on the conveyor chain.

Referring now to the drawings, and more particularly to FIG. 1, a preferred embodiment of the signature printing system of the present invention includes a plurality of feeders 10 at longitudinally spaced stations adjacent collating conveyor chain 12 for delivering signatures 30 to the conveyor chain 12 in superpositioned relationship so as to progressively build up books or collections of signatures 29 as illustrated perspectively in FIG. 12. The conveyor chain 12 conveys the books of signatures 29 past a caliper 14 which measures the thickness of the books of signatures 29 to determine if any of the books of signatures 29 has an improper number of signatures 30 or book pages 31, 33. The books of signatures 29 are next conveyed from the caliper 14 to a printing station 16. At the printing station 16, information is printed on the pages 31, 33 desired, such as customized information on inside pages 31 and mailing label information on cover pages 33 of the books of signatures 29.

The conveyor chain 12 conveys the books of signatures 29 to a stitcher 18 which stitches the books of signatures 29. From the stitcher 18, the books of signatures 29 are moved to a diverter 20 which transfers books of signatures 29 which have been determined to be faulty by the caliper 14 to the rejector 21 for rejection. Books of signatures 29 which are found to be of the proper size and otherwise in good condition are transferred by the diverter 20 to the trimmer 22 which trims the books of signatures 29. After the trimming process, an audit cell 24 monitors all of the completed books of signatures 29 to check for any missing books of signatures 29.

The functions of the signature printing system are monitored and controlled by a computerized control system. The computerized control system will include a suitable programmable general purpose digital computer 26 and its associated peripherals and sensors which are described in more detail hereinafter.

More particularly, the feeders 10 utilized in the present invention are well-known in the prior art, and may be any suitable mechanism for delivering signatures 30 onto the conveyor chain 12. Feeders 10 deliver one signature 30 at a time to locations on the conveyor chain 12 such that a plurality of feeders 10 mounted tandemly at longitudinally spaced stations adjacent the conveyor chain 12, diagrammatically illustrated in FIG. 1 as Boxes 1 through N, are capable of progressively building up books or collections of signatures 29 on the conveyor chain 12. This is shown perspectively in FIG. 12 where signatures 30 are being delivered onto a conveyor chain 12 so as to progressively build up books of signatures 29.

Figure 5:
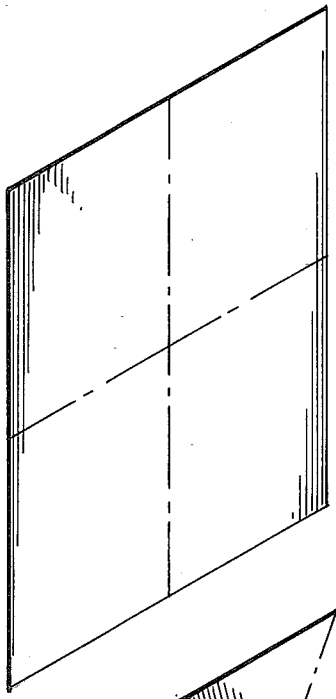
FIG. 5 is a perspective view of an unfolded signature having eight pages.
Figure 6:
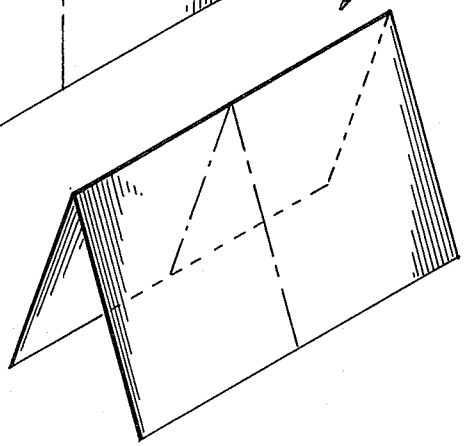
FIG. 6 is a perspective view of the signature illustrated in FIG. 5 after one fold.
Figure 7:
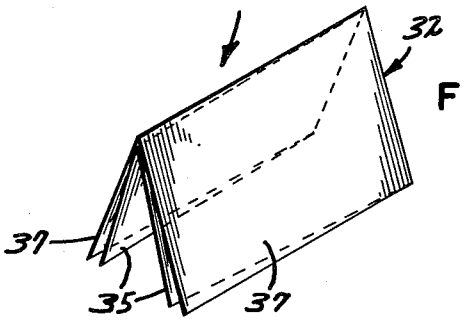
FIG. 7 is a perspective view of the signature in FIG. 5 after two folds and positioned on the conveyor chain.

FIGS. 5, 6, and 7 show a sequence for formation of a signature 30 having two centerfold pages 35 and two outside pages 37 for a total of eight pages. One must realize, of course, that a signature can have any number of pages, with a typical number being thirty-two pages. As illustrated in FIG. 12, the two outside pages 37 of the signature last delivered onto the conveyor chain 12 may form the cover pages 33 of the book of signatures 29. The remainder of the signature pages will be inside pages 31 of the book of signatures 29.

Figure 3:
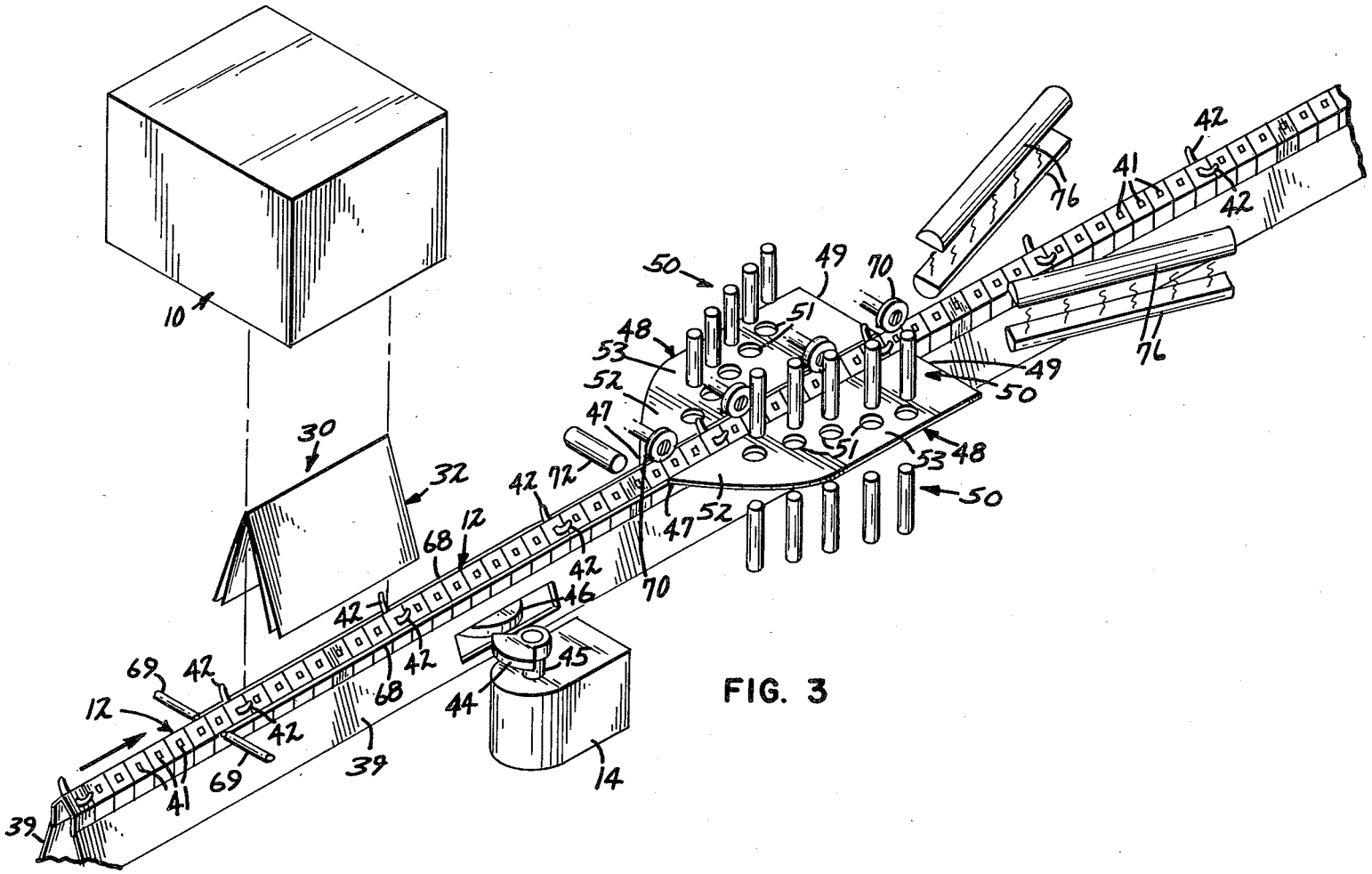
FIG. 3 is a fragmentary perspective view of a side-by-side mounting of plate-like members and adjacent portions of a signature printing system.
Figure 8:
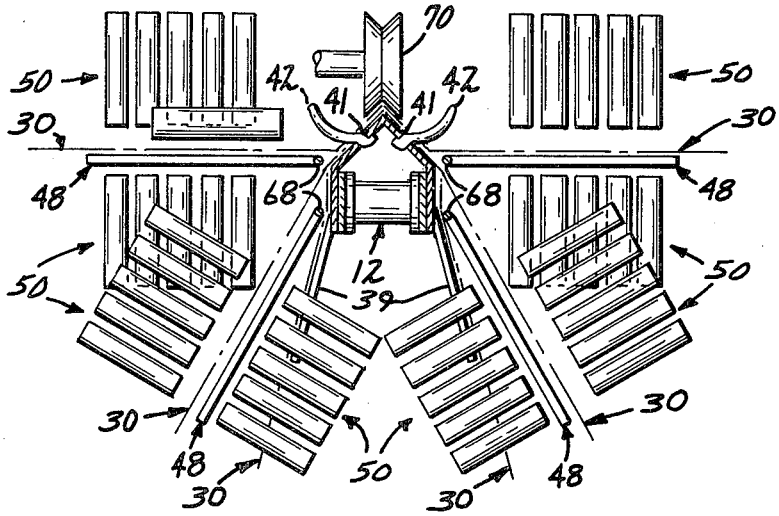
FIG. 8 is a sectional view as seen from the line 8—8 of FIG. 4 having a signature printing station with four plate-like members.

The conveyor chain 12 of the present invention may be a sprocket chain conveyor of the type well known to the prior art. The conveyor chain 12 as illustrated in FIG. 3 normally has a skirt-like member 39 projecting downward therefrom. The conveyor chain 12 is driven by a conventional chain sprocket drive shaft 40 diagramatically shown in the system block diagram of FIG. 1. As illustrated in FIG. 3, the conveyor chain 12 contains several lugs 42 attached thereto. At equally spaced locations along the conveyor chain 12, pairs of lugs 42 are removeably mounted in apertures 41 in the conveyor chain 12 as illustrated in FIG. 8. The lugs 42 project above the conveyor chain 12 thereby preventing the signatures 30 from slipping on the conveyor chain 12 as they are moved along. The pairs of lugs 42 are equally spaced from one another, such that every two pairs of lugs 42 define a location on the conveyor chain 12 where the signatures 30 are to be progressively delivered so as to build books or collections of signatures 29. While the lugs 42 are equally spaced for a given run, the spacing between lugs 42 will be adjusted between runs depending on the size of the books of signatures 29 to be printed by removing the lugs 42 from apertures 41 and inserting the lugs 42 in apertures 41 spaced a desirable distance apart.

The movement of the conveyor chain 12 is monitored by a lug detector 43 mounted adjacent the conveyor chain 12. The lug detector 43 may be any suitable photocell which sends an interrupt to the computerized control system when a lug 42 is detected. The lugs 42 and lug detector 43 enable the computerized control system to monitor where the various books of signatures 29 are located during the printing process at any given time by keeping track of the conveyor chain 12 movement. It should be understood that several separate chains and associated sprocket drive shafts may be provided throughout the entire system, so as to effectively form a continuous conveyor chain 12.

As is illustrated in FIG. 3, the caliper 14 is mounted adjacent to the conveyor chain 12 upstream of the printing station 16 and is utilized to detect books of signatures 29 which have an improper number of signatures 30 or pages 31, 33. The caliper 14 may be any suitable caliper utilized by the printing industry. The thickness of the books of signatures 29 is measured as the books of signatures 29 pass between a probe 44 of the caliper and a reference base 46. If the measured thickness of the books of signatures 29 is found to be unacceptable or out of tolerance an interrupt is sent to the computerized control system. The probe 44 of the caliper 14 is normally rotatably mounted about a shaft 45, the rotation of the caliper probe 44 being synchronized with the movement of signatures 30 along the conveyor chain 12. In FIG. 3 the skirt 39 is shown cut away between the reference base 46 and probe 44 to enable the measurements to be made.

Figure 4:
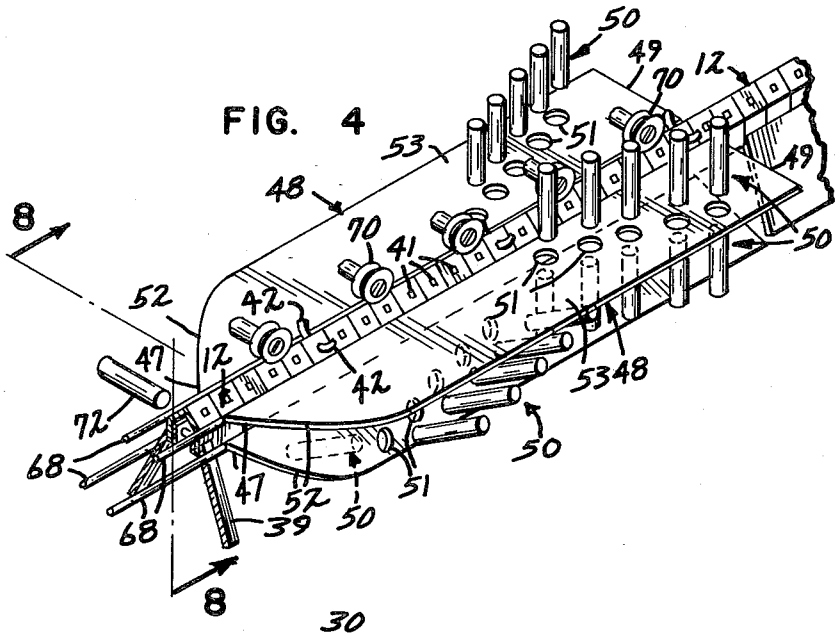
FIG. 4 is a fragmentary perspective view of fan mounted plate-like members having the printing platen portions extended to allow space for the printer heads.

As shown in FIGS. 3 and 4, the printing station 16 located downstream of the feeders 10 and caliper 14 includes printer heads 50 mounted adjacent relatively flat plate-like members 48, each of which is attached to a wire 68 extending upstream adjacent the conveyor chain 12. Each plate-like member 48 is mounted adjacent the conveyor chain 12 and lies generally in a plane extending radially from a line defined by the path of the conveyor chain 12. Each plate-like member 48 has an upstream end 47 and a downstream end 49 and has a generally rectangular shape, although any suitable shape will do. The upstream end 47 is tapered in toward the conveyor chain 12 to form a plow portion 52. The plow portion 52 extends outward from the conveyor chain 12 to form a printing platen 53. It should be noted that although multiple plate-like members 48 are shown in FIGS. 3 and 4 being mounted adjacent the conveyor chain 12, the printing station 16 may have a single plate-like member 48 with associated printer heads 50.

As is illustrated in FIGS. 3 and 4, each plate-like member 48 has the wire 68 connected to an edge of the plow portion 52 adjacent the conveyor chain 12 at the upstream end 47 of the plate-like member 48. It should be understood that any elongated member can be used in place of the wire 68. The wire 68 extends generally parallel to and adjacent the conveyor chain 12 upstream from the plate-like member 48 to a location just beyond but adjacent one of the feeders 10 feeding the signatures 30, such that the signatures 30 delivered therefrom and from feeders downstream therefrom are delivered onto the conveyor chain 12 over the wire 68. The wire 68 is attached at its upstream end to a retaining structure 69 which retains the wire in place. Note that in FIG. 8 wire 68 is shown slightly removed from the conveyor chain 12, thereby forming a space between the wire 68 and the conveyor chain 12, so those signatures 30 delivered onto the conveyor chain 12 upstream of the wire 68 will be conveyed by the conveyor chain 12 under the wire 68. Those signatures 30 delivered onto the conveyor chain 12 downstream of the wire 68 will be conveyed over the wire 68. Therefore, as the books of signatures 29 are progressively built up, some of the pages 31, 33 will be positioned over the wire 68. In this fashion, the wire 68 is able to select the signature 30 where the books of signatures 29 are to be opened by the plate-like member 48. In the case where there are a plurality of plate-like members 48, each having a wire 68 attached, each wire 68 may extend upstream adjacent the conveyor chain 12 to differing locations adjacent the feeders 10 such that different signatures 30 are selected by the wires 68 from a plurality of feeders 10.

When the books of signatures 29 which include signatures 30 delivered over the wire 68, are conveyed past plate-like member 48, the plate-like member 48 cooperates with the conveyor chain 12 and wire 68 to move a page of the selected signature out of superpositioned relationship with a signature delivered to the conveyor just prior to the delivery of the selected signature and thereby open the books of signatures 29 at the signature 30 selected for opening by the wire 68 to expose an inside page of the book of signatures. The plow portion 52 lifts the pages 31, 33 of the books of signatures 29 delivered over the wire 68 onto the printing platen 53 while the pages 31, 33 of the book of signatures 29 not delivered over the wire 68 are left hanging substantially vertically from the conveyor chain 12, thereby forming two groups of pages 31, 33 located in planar positions arcuately spaced from each other and each extending approximately radially from a line defined by the path of travel of the conveyor chain 12 past the plate-like member 48. Note that those pages 31, 33 not over the wire 68 include those pages 31, 33 physically under the wire 68 between the wire 68 and the conveyor chain 12 and those pages hanging from the other side of the conveyor chain 12 as shown in FIG. 8. The pages 31, 33 lifted by the plow portion 52 are retained in a planar position which is roughly parallel to the plate-like member 48 and which extends generally radially from a line defined by the path of travel of the conveyor chain 12 as the conveyor chain moves the pages 31, 33 over the surface thereof. A plurality of the plate-like members 48 enable each book of signatures 29 to be opened at a plurality of selected signatures 30 as each book of signatures 29 is conveyed past the plate-like members 48.

The signatures 30 are retained on the conveyor chain 12 in their open condition by rollers 70, illustrated in FIGS. 3 and 4, mounted above the conveyor chain 12. The rollers 70 bias the binding of the books of signatures 29 downward against the conveyor chain 12 so as to offset any tendency the books of signatures 29 might have to be lifted upward from the conveyor chain 12.

Figure 13:
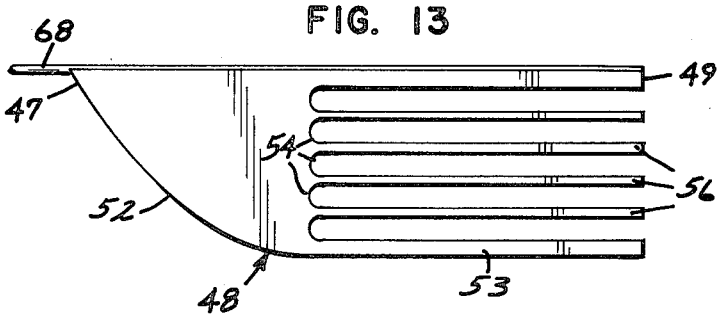
FIG. 13 is a plan view of a plate-like member having multiple elongated apertures.
Figure 15A:
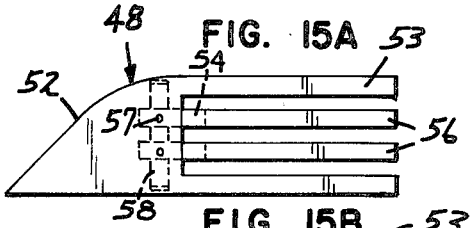
FIGS. 15A–15D are varying views of a plate-like member having adjustable appendages.
Figure 14:
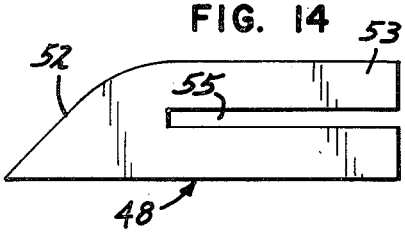
FIG. 14 is a plan view of a plate-like member having a single elongated aperture.
Figure 15B:
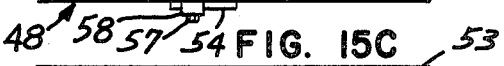
Figure 15C:
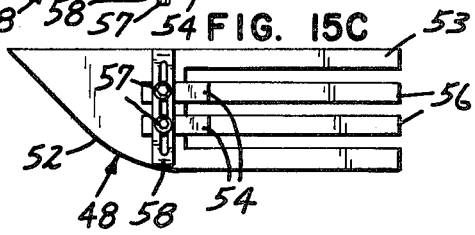
Figure 15D:
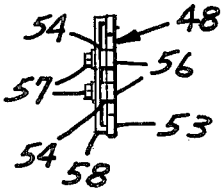

The printing platen 53 has apertures 51 therein to allow printing by the printer heads 50 mounted below the printing platen 53 on pages 31, 33 as they are moved over the surface of the printing platen 53. Although the apparatus 51 are shown as cylindrical openings in FIGS. 4 and 8, the apertures 51 may take on other various shapes and arrangements as is illustrated in FIGS. **13–15*d*. As is shown in FIG. 13, the apertures 51 frequently take the form of elongated apertures 55 formed by a plurality of elongated appendages or fingers 56 extending roughly parallel the conveyor chain 12 to the downstream end 49 of the printing platen 53. The apertures 55 are preferably open at the downstream end 49 so that the freshly printed ink is not smeared by the surface of the printing platen 53. While there are four fingers 56 shown in FIG. 13, there may be any number of fingers 56. As illustrated in FIG. 14, there is only one elongated aperture 55. As shown in FIGS. 15A–D, there are two adjustable fingers 56. The fingers 56 each may be made adjustable in any number of ways and in FIGS. 15A–D are shown as each being attached to the top surface of an elongated rectangular splice plate 54. The splice plates 54 are slidingly attached via bolts 57 to a slotted support member 58 attached to the bottom of the printing platen 53 such that the fingers 56 are adjustable radially from the conveyor chain 12**.

The printing platen 53 with its apertures 51 allows printer heads 50 to be mounted below the printing platen 53 in alignment with the apertures 51 or 55 to enable printing on a centerfold page 35 of a selected signature 30 facing and immediately adjacent the printing platen 53 as the pages 31, 33 are conveyed by the conveyor over the plate-like member. In addition, the printer heads 50 can be mounted above the printing platen 53 so as to be capable of printing on the outside page 37 of a signature 30. The plate-like member 48 thus enables the near simultaneous printing of two or more pages, such as the inside page 31 and the cover page 33, of a book of signatures 29.

Figure 2:
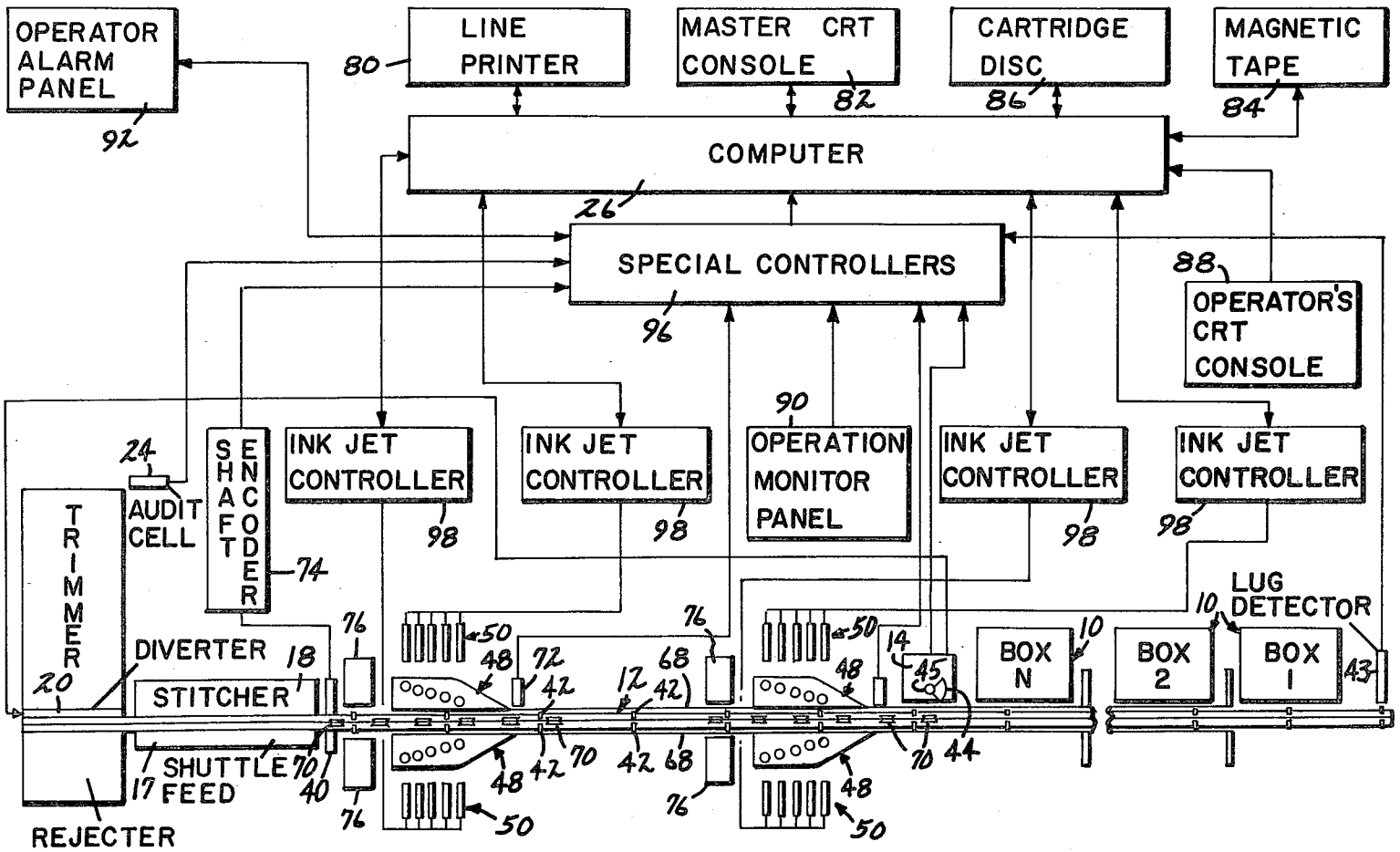
FIG. 2 is a block diagram of a signature printing system utilizing side-by-side and tandem mounting of plate-like members.

As is shown in FIGS. 1 and 2, another plate-like member 48 can be mounted adjacent the conveyor chain 12, opposite of the above mentioned plate-like member 48 at the same longitudinal location along the conveyor chain 12 to enable the printing of another centerfold page 35 and outside page 37 of the same signature 30 or of a different one. In addition, printer heads 50 can be mounted horizontally underneath the plate-like members 48 to print on the outside pages 37 of the signatures 30 hanging in a substantially vertical plane on the conveyor chain 12 unopened. Should it be necessary to print on more pages 31, 33, additional plate-like members 48 could be fan mounted about the conveyor chain 12 as illustrated in FIG. 4. The number of plate-like members 48 which can be fan mounted will depend on the size and arrangement of the printer heads 50 utilized.

If the plate-like members 48 become so numerous in a fan mounting configuration so as to not allow room to mount the printer heads 50, the plate-like members 48 can be staggered or mounted tandemly along the conveyor chain 12, as is illustrated in FIG. 2, or the printing platens 53 of the fan mounted plate-like members 48 could be extended in length, as is illustrated in FIG. 4, such that the printer heads 50 need not be mounted directly above and below each other but can be longitudinally off-set from each other along the printing platen 53. This is illustrated in the end view shown in FIG. 8, where four plate-like members 48 with extended printing platens 53 are utilized to provide the capability to print on eight pages 31, 33 of each book of signatures 29. The various configurations of the plate-like members 48 enable a virtually unlimited number and combination of pages 31, 33 of each book of signatures 29 to be printed.

Figure 9:
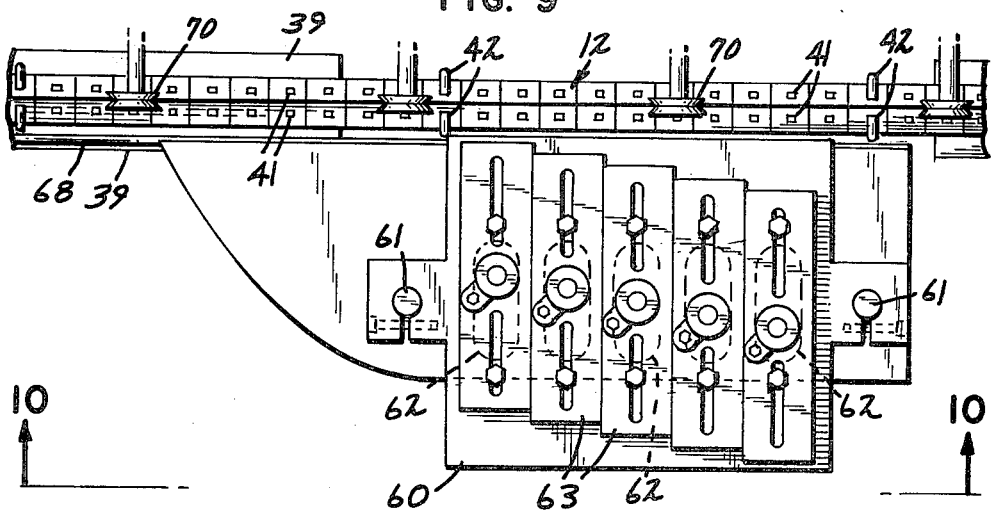
FIG. 9 is a fragmentary top plan view of a printing station mounting structure.
Figure 10:
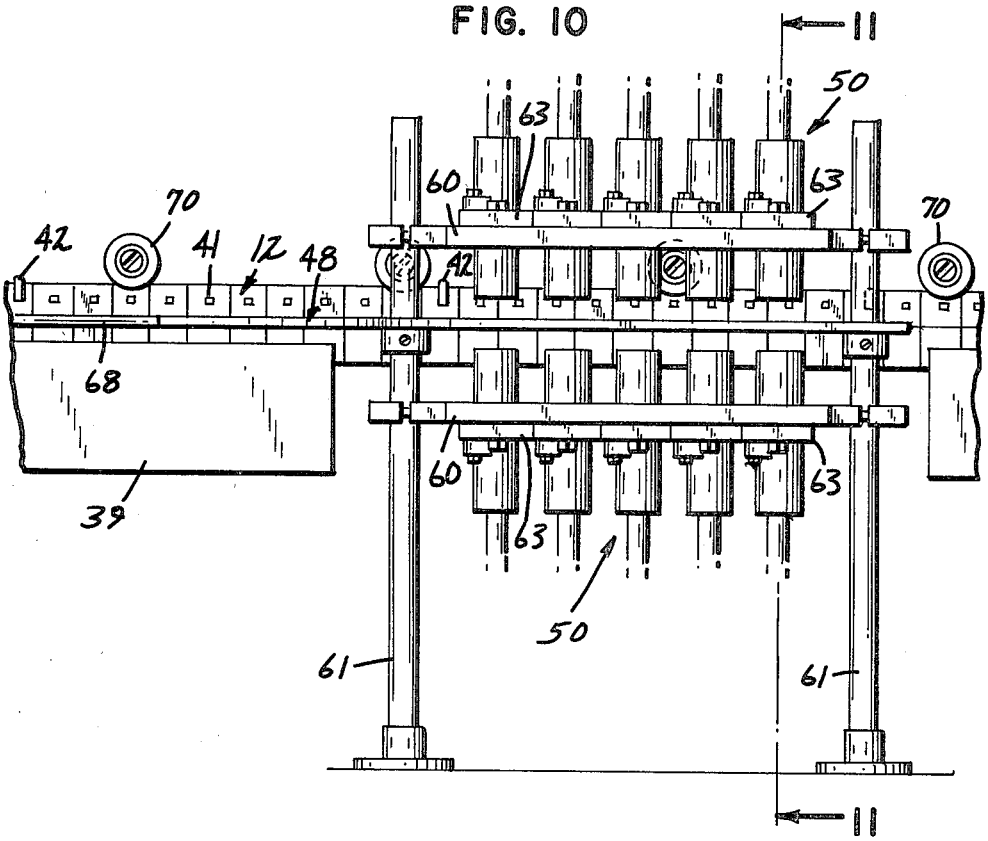
FIG. 10 is an elevated view as viewed from the lines 10—10 of FIG. 9.
Figure 11:
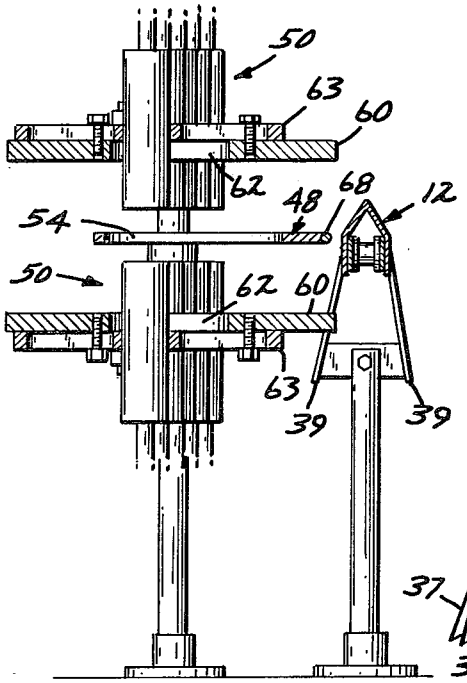
FIG. 11 is a view in vertical section as seen generally from lines 11—11 of FIG. 10.

The plate-like member 48 may be supported adjacent the conveyor chain in any suitable manner, the method of mounting being obvious to those skilled in the art. Illustrated in FIGS. 9–11 is an example of a mounting structure constructed and arranged to support the plate-like member 48 and the associated printer heads 50 for printing on two pages, such as an inside page 31 and a cover page 33, of a book of signatures 29. Plate-like member 48 is shown as being supported by vertically upright mounting standards 61. The mounting standards 61 are shown supporting printer head mounting plates 60 above and below said plate-like member 48. The printer head mounting plates 60 contain elongated apertures 62 therein so as to enable the printer heads 50 to extend vertically through the plates so as to be in close proximity to the plate-like member 48 and to enable the printer heads 50 to be adjustable radially from the conveyor chain 12. The printer heads 50 are attached to sliding members 63 positioned on the mounting plates 60 at varying distances from the conveyor chain 12.

The printer heads 50 are desirably of a dot matrix non-contact type. The printer heads 50 of the dot matrix type are positioned adjacent the plate-like member 48 so as to be able to selectively print dots in a matrix to form characters on an inside page 31 or an outside page 33 or any combination thereof of the books of signatures 29 as the conveyor chain 12 conveys each book of signatures 29 past the plate-like member 48.

More particularly, the printer heads 50 are desirably of the ink jet type well known in the art and utilized in U.S. Pat. No. 4,121,818. As the signatures 30 move past the printer heads 50 matrices of dots are selectively printed by projecting droplets of ink along a direction transverse to the direction of movement of the conveyor chain 12, thereby creating alphanumeric characters on the pages 31, 33 of each book of signatures 29 as conveyed past printer heads 50. Each plate-like member 48 will usually have a number of printer heads 50 which equals the number of lines of information to be printed as the book of signatures 29 is conveyed past the plate-like member 48 since each printer head 50 is capable of printing one line of information. Operation and control of the printer heads 50 is well known to the art.

As illustrated in FIG. 1, positioned immediately upstream of the plate-like member 48 is a leading edge detector 72 for detecting the leading edge 32 of books of signatures 29 as they arrive at the printing station 16. The detector 72 may be any suitable photocell. The leading edge detector 72 sends an interrupt to the computerized control system whenever a leading edge 32 is detected.

A shaft encoder 74 driven by the conveyor chain sprocket drive shaft 40, which is diagramatically illustrated in FIG. 1, detects the movement of the conveyor chain 12 and together with the leading edge detector 72 is utilized by the computerized control system for proper spacing and indexing of characters printed on the books of signatures 29. Shaft encoders and their uses are well-known to the art.

As shown in FIG. 3, strip heaters or dryers 76 are mounted adjacent the printing station 16 to assure quick and efficient drying of the ink by direct and reflected infra-red techniques. Preferably the dryers 76 are mounted adjacent the elongated apertures 55 of the printing platen 53 as illustrated in FIG. 14 so the fresh ink is dried as the pages 31, 33 move along the elongated apertures 55.

As shown in FIG. 1, after the ink is dried, shuttle feed 17 feeds the signatures 30 past a stitcher 18 which stitches the binding of the books of signatures 29. A diverter 20 transfers books of signatures 29, when so notified by the caliper 14, to contain an improper number of signatures 30 to a rejector 21. Books of signatures 29 which are found to have a proper number of signatures 30 are diverted to a trimmer 22 for trimming. The shuttle feed 17, stitcher 18, diverter 20, rejector 21, and trimmer 22 are all well known to the art of printing and any suitable embodiment may be utilized.

An audit cell 24 senses and notifies the computerized control system, after the trimming process is complete, whether or not there are any books of signatures 29 missing from the assembly line just prior to stacking for mailing. The audit cell 24 sends an interrupt to the computerized control system if a book of signatures 29 is determined to be present. If any books of signatures 29 are found to be missing, the control system reprints the information contained in those books of signatures 29. The audit cell 24 thus serves as a final automated check of whether any books of signatures 29 are missing for any reason, such as being removed after being cut up by the trimmer 22, thereby assuring as nearly as possible that all subscribers will receive a book of signatures 29. The audit cell 24 may be of any suitable photocell type.

THE CONTROL SYSTEM

Figure 16:
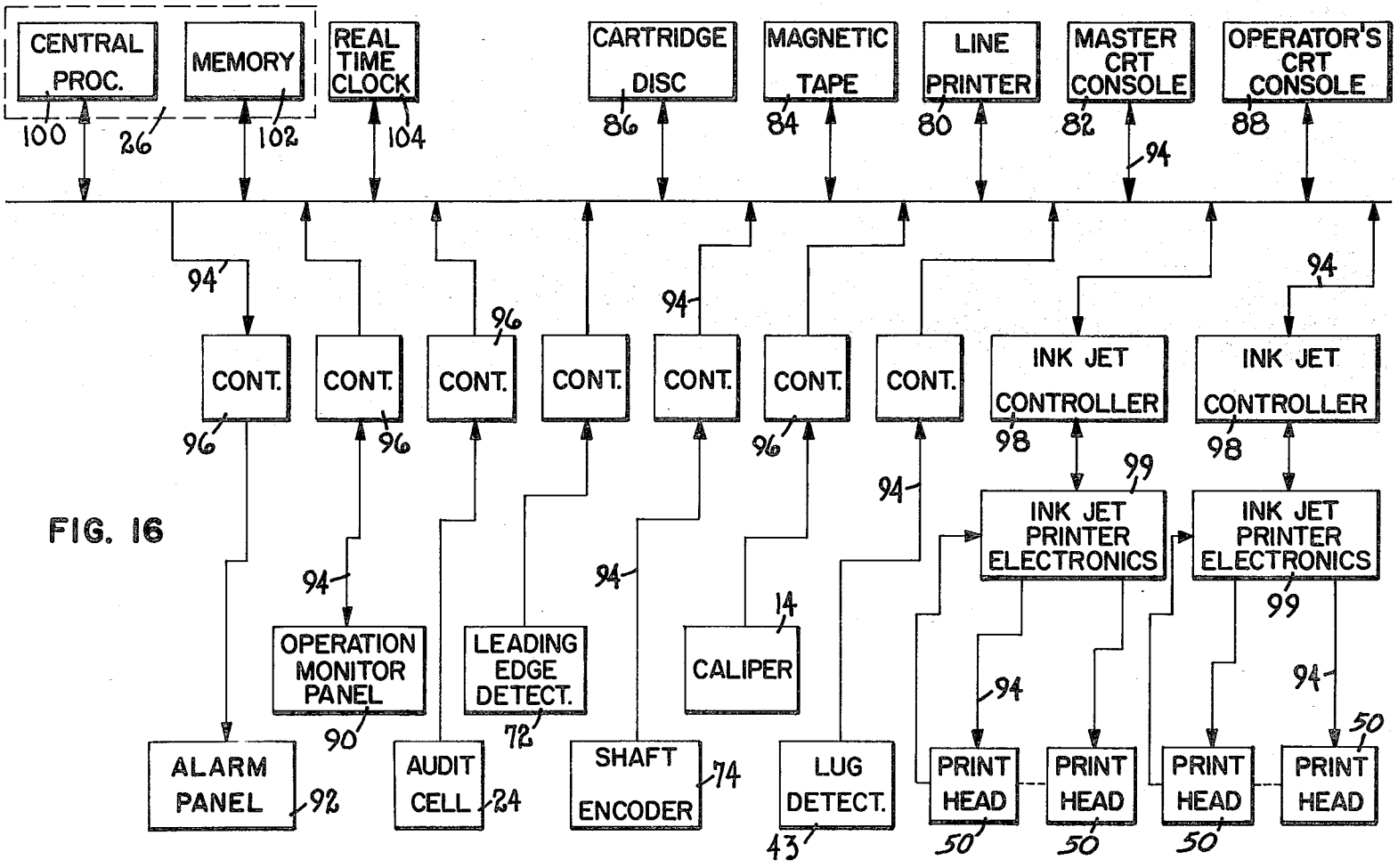
FIG. 16 is a block diagram of the computerized control system.

It is contemplated that the signature printing system will be monitored and controlled by a computerized control system, a preferred embodiment of which, as is illustrated in FIGS. 1 and 16, includes the following elements or equivalents thereof: a programmed general purpose computer 26, a line printer 80, a master CRT console 82, a magnetic tape storage device 84, a cartridge disc storage device 86, an operator CRT console 88, an operation monitor panel 90, an alarm panel 92, associated communications lines 94 between the programmed general purpose computer 26 and the various elements of the signature printing system (audit cell 24, leading edge detector 72, shaft encoder 74, caliper 14, and lug detector 43), various special controllers 96, ink-jet printer controllers 98, and ink-jet printer electronics 99.

In general, the computerized control system performs the following functions during system operation:

a. monitors where the books of signatures 29 are at in the signature printing process via the lug detector 43 which detects conveyor chain 12 movement;

b. monitors whether the books of signatures 29 contain a proper number of pages 31, 33 via the caliper 14;
c. initiates printing at the printing station 16 of books of signatures 29 which contain a proper number of pages 31, 33;
d. inhibits printing of books of signatures 29 determined to contain an improper number of pages 31, 33 by the caliper 14;
e. initiates printing, on the next sequential book of signatures 29 found to contain a proper number of pages 31, 33 of the information which is not printed on the faulty book of signatures 29;
f. prints a mail distribution change mark on the books of signatures 29 when a mail distribution change occurs.
g. monitors via the audit cell 24 the presence or absence of books of signatures 29 prior to stacking of the books of signatures 29 for mailing;
h. reprints the customized information and mailing information contained by the books of signatures 29 found to be missing by the audit cell 24 if so desired;
i. notifies via the alarm panel 92 when the system is approaching an end of run, when there is an end of run, when a mail distribution change has occurred and a book of signatures 29 so marked is determined to be present by the audit cell 24, when a mail distribution change has occurred but the book of signatures 29 containing the mail distribution change mark is determined to be missing by the audit cell 24;
j. presents detailed system status at the operation monitor panel 90;
k. prints system status and job information at the line printer 80; and
l. displays system status at master CRT console 82 and operator's CRT console 88.

The computer 26 may be any suitable commercially available computer which includes a central processor 100, and a memory 102 or the equivalent thereof. The central processor 100 enables execution of preprogrammed instructions which may be loaded into the memory 102 of the computer 26 from any suitable mass storage device such as magnetic tape 84. An external real-time clock 104 enables synchronization and timing of computer 26 operation. The communication lines 94 enable communications between the computer 26 and the various sensors and devices of the signature printing system.

Subscriber customized information and mailing label information is prepared for storage on a mass storage medium which is capable of being accessed by the computer 26. In the preferred embodiment of the present invention, the magnetic tape storage device 84 is utilized to store the subscriber information. The mass storage medium is prepared by any one of many common well-known data processing techniques wherein subscriber information is stored according to a pre-determined machine readable format. To facilitate the mailing and sorting of books of signatures 29, the subscriber information should be stored on tape so information relating to subscribers in a particular mail distribution sequence can be printed sequentially as a group, thereby assisting in the grouping of books of signatures 29 for mailing purposes.

The computerized control system can operate on the stored subscriber information in several different ways depending on the particular system structure; i.e., computer, printers, consoles, etc., and programming utilized. Various computerized control system arrangements can be utilized, the system disclosed herein being but one of an endless variety of choices for implementing control of the signature printing system.

In the preferred embodiment, the cartridge disc 86 is used to store subscriber information which must be reprinted due to books of signatures 29 found to be missing by the audit cell 24. When a book of signatures 29 is detected as missing, the computerized control system will determine what information had been printed on the missing book of signatures 29 and will store that information on the cartridge disc 86. At the end of a run after having printed the subscriber information contained on magnetic tape 84, the computerized control system will check if there is any subscriber information on the cartridge disc 86 which needs to be reprinted. If there is, the computerized control system will print the information from the cartridge disc 86. Note that, as explained hereinafter, the operator has the option of selecting whether reprinting is to occur at the end of a run. Note also that the subscriber information to be printed during a given run might be on more than one tape.

In the preferred embodiment, the line printer 80 is used for hard copy print-out of signature printing system status and other information of interest to an operator. The operator can use this information for troubleshooting and isolating system problems as well as determining signature printing system status at any given time. The line printer 80 can also be used for print-out of job information; e.g. customer name, number of signature books 29 printed, type of books of signatures 29 printed, etc.

The master CRT console 82 and operator's CRT console 88 enable operator input to the computer 26. In addition, the consoles 82, 88 are capable of displaying computer 26 output. The master CRT console 82 is located in close proximity to the computer 26 and used mainly for initializing and starting the computerized control system. The operator's CRT console 88 is located in close proximity to the conveyor chain 12 with its various stations and used mainly for displaying signature printing system status to the operator and for operator control of signature printing system operation once the computerized control system has been initialized and started.

In the preferred embodiment, the operation monitor panel 90 which is located in close proximity to the computer 26 is normally used for trouble shooting purposes as it displays detailed system status via various indicators.

The alarm panel 92 is located next to the conveyor chain 12 with its various stations and is used for providing various visual and audio alarm indications such as approaching the end of a run, end of run, mail distribution change and a book of signatures 29 so marked with a mail distribution change mark is present, and mail distribution change but the book of signatures 29 so marked is missing. Note that while only one alarm panel 92 is shown in FIG. 1, there may be several scattered throughout the system.

The special controllers 96 and ink-jet controllers 98 along with the ink-jet electronics 99 enable the computerized system to interface with the various elements of the signature printing system by providing for the proper formatting and timing of information transfer on the communication lines 94. As illustrated in FIGS. 1 and 16, there is an ink-jet controller 98 and associated ink jet printer electronics for each set of printer heads 50, the operation and control of which being well known in the art. Each ink-jet controller 98 and associated ink-jet printer electronics 99 is typically capable of controlling up to six individual printer heads 50. In FIG. 16, a dashed line is drawn between printer heads 50 to indicate from one to six heads per controller 98. Note that while the communication lines 94 are drawn as one line, they may actually represent several wires or cables.

Prior to initiating the computerized control system, a preformatted tape containing subscriber information is placed on the magnetic tape storage device 84. An operator at the master CRT console 82 then positions the tape via computer program control or manually so it is ready for access by the computer 26.

After starting the computer program the operator enters various parameters from the master CRT console 82 which are necessary for proper initialization of the computer program. Examples of parameters the operator must enter prior starting a signature printing system run are as follows:

(a) the number of books of signatures 29 before the end of a run that the approaching end of run alarm is to be sent to the alarm panel 92;

(b) whether books of signatures 29 found missing by the audit cell 24 are to be reprinted;

(c) how the subscriber information is formatted and located on the preformatted tape; e.g. which information fields are allocated to subscriber name, street number, town, etc.;

(d) the number of lugs 42 between the caliper 14 and printing station 16;

(e) the number of lugs 42 between the printing station 16 and audit cell 24;

(f) whether double label information is to be printed on a book page 31, 33;

(g) the run identifier and description;

(h) number of ink-jet controllers 98 to be used;

(i) nature of information to be printed by each ink-jet controller 98; and (j) how far offset from the leading edge 32 of a signature book 29 information is to be printed.

Note, the above are but some examples of the type of system parameters which are necessary for system initialization and should not be considered as limiting the extent of operator parameter entries as this will vary from system to system.

Figure 17:
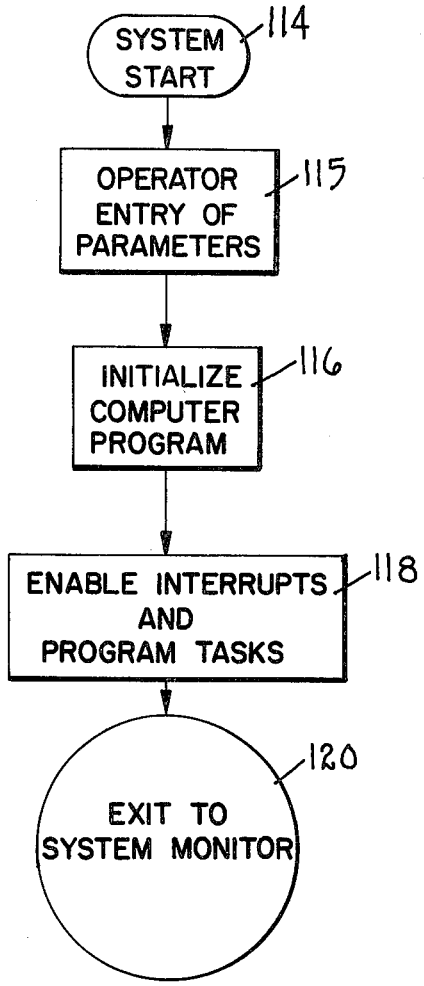
FIG. 17 is a logic flow chart for start-up of the computer program.

As illustrated in FIG. 17, after the operator has started the computer program at block 114 and has entered various system parameters at block 115, the computer program initializes its data stores; i.e. arrays, tables, counters, variables, buffers, etc. as indicated at block 116. The computer program then enables interrupts from the various signature printing system sensors and devices and initializes program tasks or functions.

The computer program has a number of standard tasks for executive, supervisory, utility, communication, and other various tasks in addition to the tasks for controlling the signature printing system. The operation of the standard tasks is well-known to those skilled in the art. For clarity, only certain aspects of the logical flow paths associated with the tasks for controlling the signature printing system will be described in detail herein, the other alternatives and possibilities in the logic flow paths being apparent. The program tasks for controlling the signature printing system for ease of explanation and clarity have been broken down into four programmed tasks labelled master queue, print manager, digital IO manager, and audit manager as illustrated in FIGS. 15–18 and described in more detail hereafter.

It will be appreciated, however, by those skilled in the computer art that other logic arrangements may be employed to achieve the functional results of the present invention. When not performing the various tasks, the computer program returns to a system monitor task as indicated by block 120, which is a standard executive housekeeping task. In the system monitor task, the computer program 26 monitors the various activities of the computerized control system by responding to interrupts and initiating program tasks as necessary.

Figure 18A:
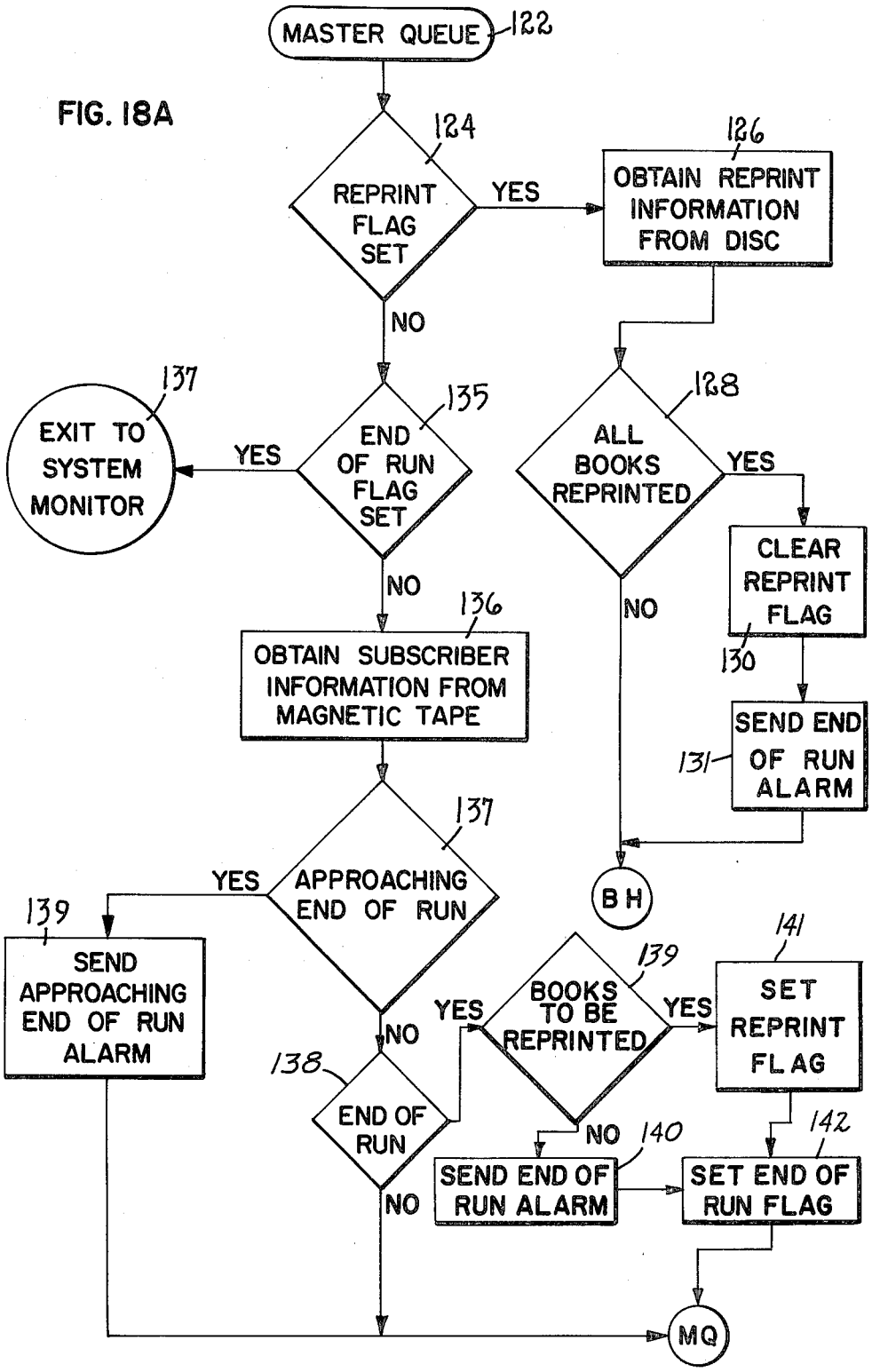
FIGS. 18A, 18B are a logic flow chart for the master queue program task.
Figure 18B:
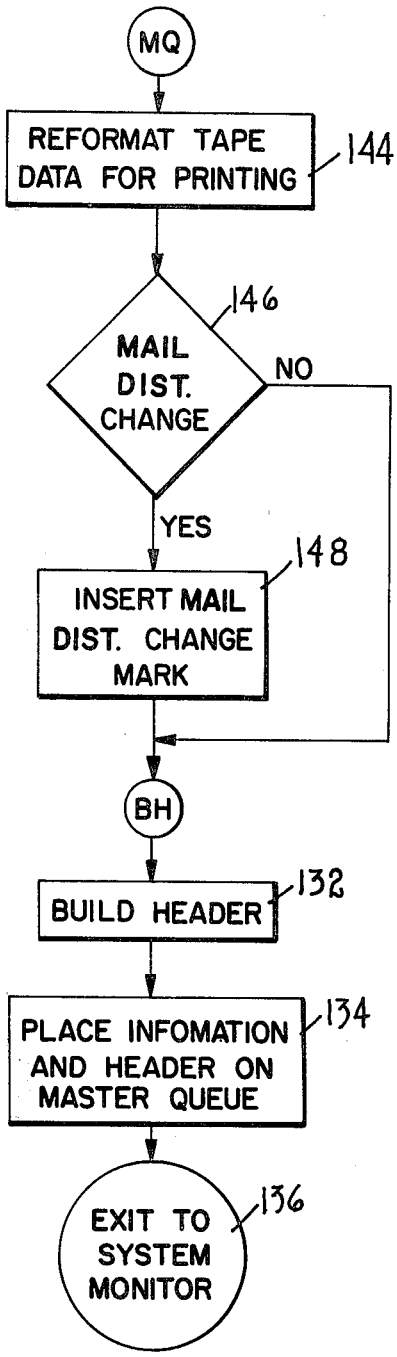

As illustrated in FIGS. 18A and 18B, the master queue task starting at block 122 reads the subscriber information off the magnetic tape 84 or cartridge disk 86 and reformats the information for printing. Note that the logic flow is illustrated by arrowed lines. In certain of the other tasks it is is not feasible or possible to illustrate the logic flow interconnected by arrowed lines, e.g., where the logic flow extends onto another page, so logic flow connectors indicated by encircled letters are utilized to indicate the logic flow in such instances. After reformatting the information, the master queue task places the information in an area of core memory 102 referred to as the master queue 300 diagrammatically illustrated in FIG. 22.

Figure 22:
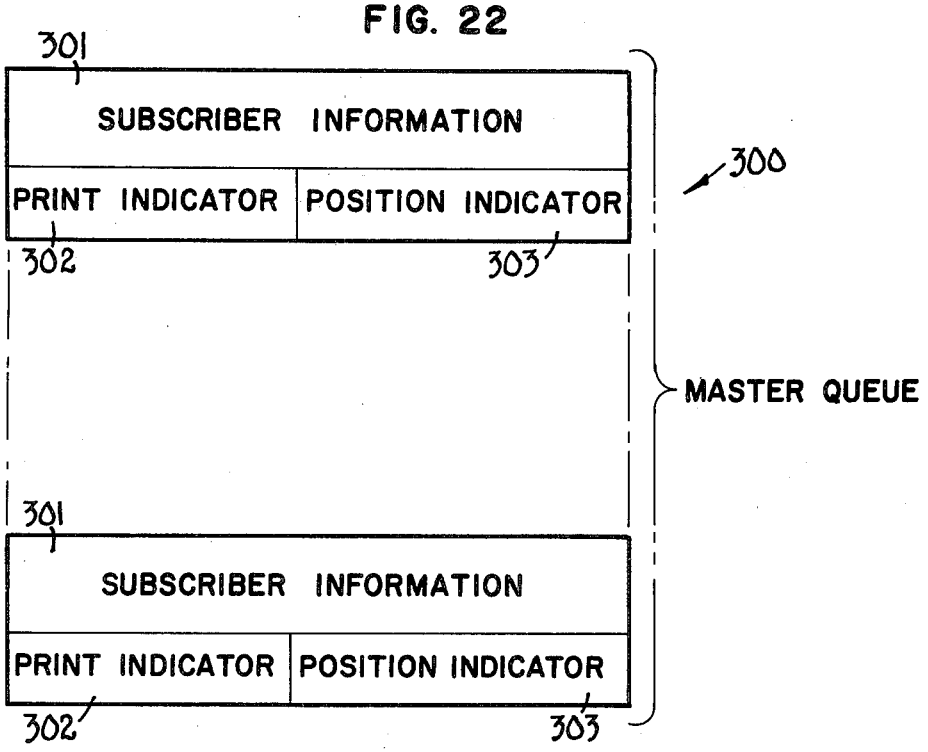
FIG. 22 is a diagrammatic representation of the master queue in core memory.
Figure 23:
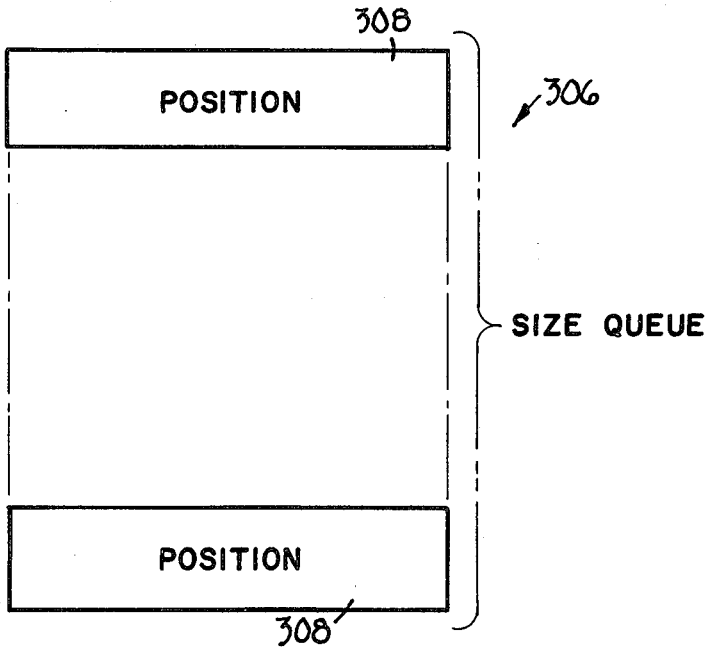
FIG. 23 is a diagrammatic representation of the size queue in core memory.

The master queue 300 is the area of core memory 102 in the computer 26 where the subscriber information for each signature book 29 is stored for access by the print manager task after being loaded into core memory 102 from magnetic tape 84 or cartridge disc 86. The print manager task accesses the master queue 300 when printing of books of signatures 29 occurs. In addition to a subscriber information field 301 containing the subscriber information to be printed on each book of signatures 29 and an identifying header, the master queue 300 contains other fields of information. As illustrated in FIG. 22, the master queue 300 contains a print field 302 and a position indicator field 303 for each set of subscriber information. As each book of signatures 29 is printed, the print indicator field 302 associated with the subscriber information field 301 is set indicating a book of signatures 29 is now on the conveyor chain 12 with this information. Once a book of signatures 29 is so printed, the associated position indicator field 303 is incremented by the digital IO manager task whenever a lug 42 is detected by the lug detector 43. In this way, the computerized control system monitors how far along in the signature printing process the books of signatures 29 have progressed. As mentioned earlier, one of the parameter entries made by the operator at system start-up is the number of lugs 42 between the leading edge detector 72 and the audit cell 24.

Thus, for example, if the operator indicated the audit cell 24 was theiry-seven lugs 42 from the leading edge detector 72, when the position indicator field 303 is incremented to 37 the computerized control system will know a printed book of signatures 29 containing the subscriber information in the associated subscriber information field 301 should be present at the audit cell 24. If the audit cell 24 doesn't detect a book of signatures 29 present at this location on the conveyor chain 12 and if the operator in his parameter entries indicated missing books of signatures 29 are to be reprinted, the subscriber information in the subscriber information field 301 is placed on the cartridge disc 86 to be reprinted and the subscriber information for the missing signature book 20 is deleted from the master queue 300.

If a book of signatures 29 is detected as being present by the audit cell 24, the subscriber information on that book of signatures 29 is deleted from the master queue 300 as there is no longer any need for retaining the subscriber information in the master queue 300. Note that if might be desirable to wait until the books of signatures 29 have traveled some distance beyond the audit cell, e.g., five lug 42 positions, before the subscriber information is removed from the master queue 300.

As indicated by decision block 124 in FIG. 18A, the master queue task checks a reprint flag to see if in the reprint made, i.e., missing books of signatures 29 are currently being reprinted. If books of signatures 29 are being reprinted then, as indicated by block 126, the reprint information is obtained from the cartridge disc 86. At 128, a check is made to see if all the missing books of signatures 29 have been printed. If so, at 130 the reprint flag is cleared and at 131 the end of run alarm is sent to the alarm panel 92 indicating printing of books of signatures 29, including those missing, has been completed. Next, as indicated by logic flow connector BH, regardless of whether reprinting is completed or not, an information header record identifying the formatted subscriber information is built at block 132, illustrated in FIG. 18B, after which the information with its header record is placed on the master queue at block 134 and then at 136 the program exits to the system monitor.

If at 124 the reprint flag was not set, indicating the master queue task is not in the reprint mode, a check is made at 135 to see if all the subscriber information has been obtained from the magnetic tape 84. If so, a return to system monitor occurs at 137. If any subscriber information remains on magnetic tape 94, it is obtained from the magnetic tape 84 at block 136. At 137 a check is made to see if approaching end of run. This check is made based on the parameter entry by the operator which indicates how many books of signatures 29 before the end of run the operator wants an alarm sent to the alarm panel 92. If approaching an end of run, at 139 the approaching end of run an alarm is sent to the alarm panel 92.

Next, as indicated via logic flow connector MQ, the tape data is reformatted for printing at 144. At decision block 146 a check is made for a change in mail distribution. If there is a mail distribution change, at 148 a mail distribution change mark is inserted in the reformatted subscriber information so it will be printed on the book of signatures 29 along with the subscriber information and the logic then follows along blocks 132 through 136. If there was no mail distribution change the computer program performs steps 132–136. The mail distribution change mark will indicate to the personnel sorting the books of signatures 29 for mailing that a new bundle, sack, or pallet is to be started.

If at decision block 137 it was determined the signature printing system was not approaching an end of fun, a check is then made at decision block 138 to see if all the subscriber information has been obtained from magnetic tapes 84. If it has, at 139 a check is made to see if the operator via parameter entries indicated that missing books of signatures 29 were to be reprinted. If books of signatures 29 are to be reprinted, at 141 the reprint flag is set and at 142 the end of run flag is set. If missing books of signatures 29 are not to be reprinted at 140, the end of run alarm is sent to the alarm panel 92 and then at 142 the end of run flag is set. Next, as indicated by logic flow connector MQ, steps 144 through 136 are performed in FIG. 18*b*.

Figure 19:
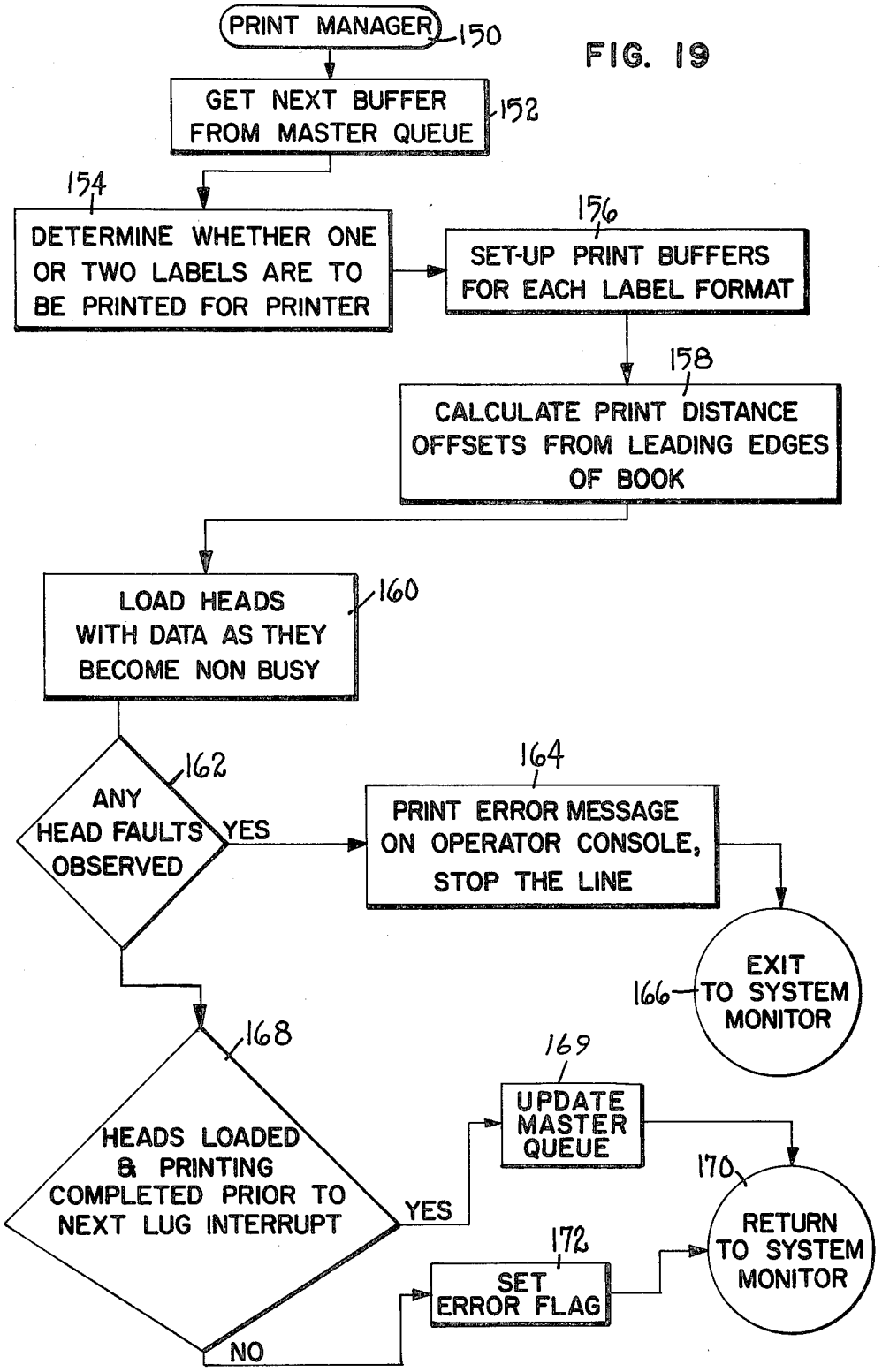
FIG. 19 is a logic flow chart for the print manager program task.

As illustrated in FIG. 19, the print manager task controls the printing of subscriber information at the printing station 16. The print manager starts at block 150 and obtains the next subscriber information to be printed from the master queue at block 152. At 154, the print manager determines whether a duplicate set of subscriber information or double label is to be printed on a book page 31, 33. Note that this is one of the parameter entries made by the operator when the system is first started. At 156, the buffers for each label format are created for the printer heads 50. At 158, the offset distance from the leading edge of a book of signatures 29 is calculated based on the operator's parameter entry when the system is first started. At 160 the printer heads 50 are loaded with data as they become non-busy. A check is then made at 162 for any printer head faults. If a printer head fault is observed, an error message is printed at the operator console 88 and the signature printing system is stopped at 164. The print manager task then exits through the system monitor at 166.

If no faults were observed a check is next performed at 168 to see whether all the printer heads 50 are loaded and printing completed prior to the next interrupt being received from the lug detector 43. If all printing has been completed, 169 the print indicator field 302 of the master queue is set indicating the subscriber information in the subscriber information field 301 has been printed and then the print manager task returns to the system monitor at 170. If all printing is not completed prior to receipt of the next lug interrupt an error flag is set indicating the book of signatures 29 is not printed at 172. A return to the system monitor at 170 is then performed.

Figure 20A:
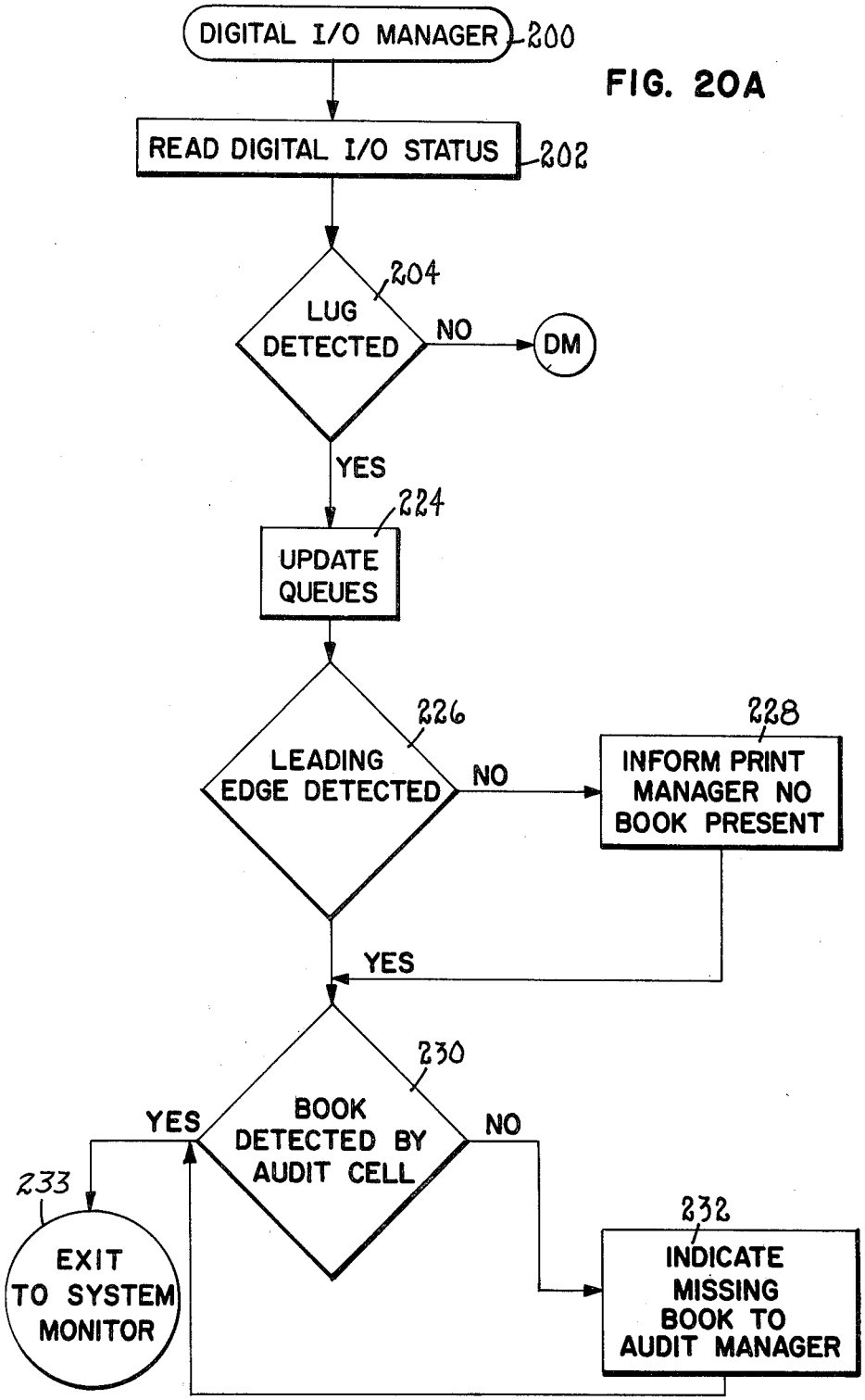
FIGS. 20A, 20B are a logic flow chart for the digital I/O manager program task.
Figure 20B:
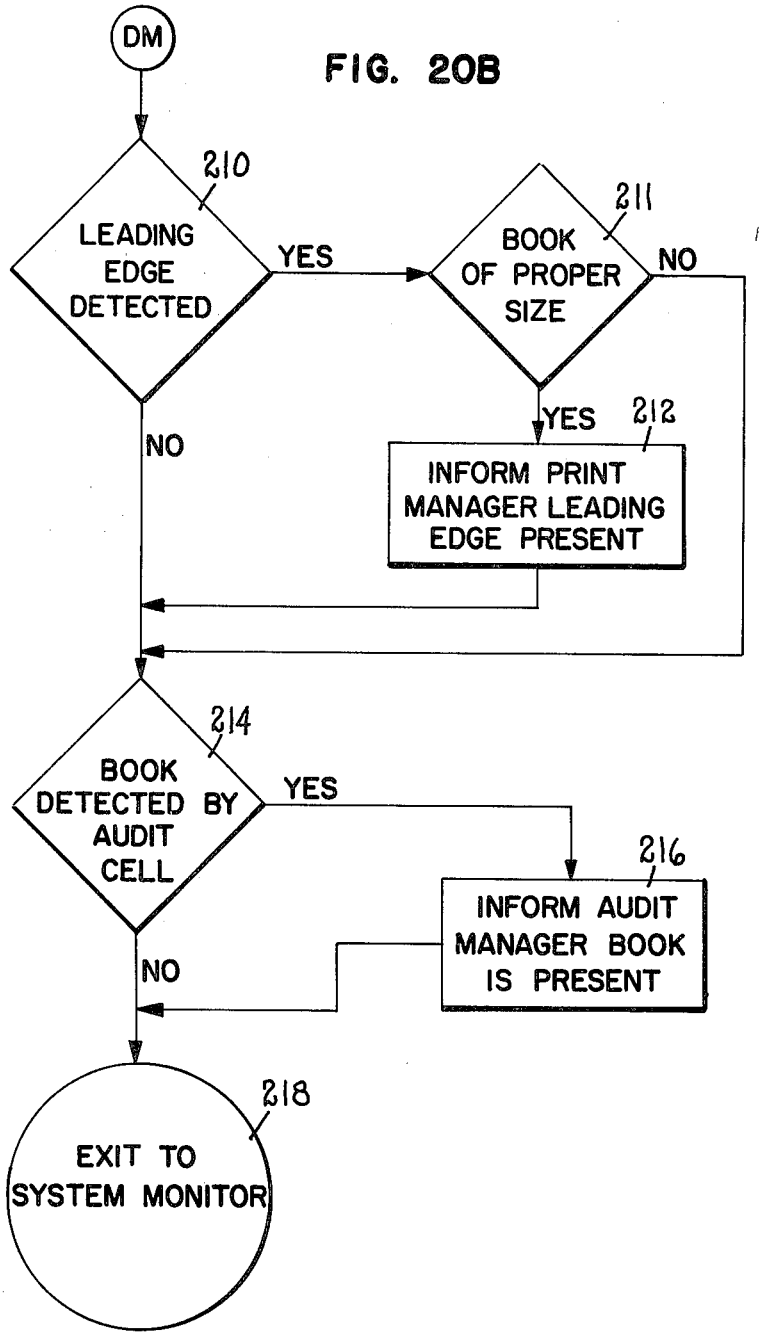
Figure 21:
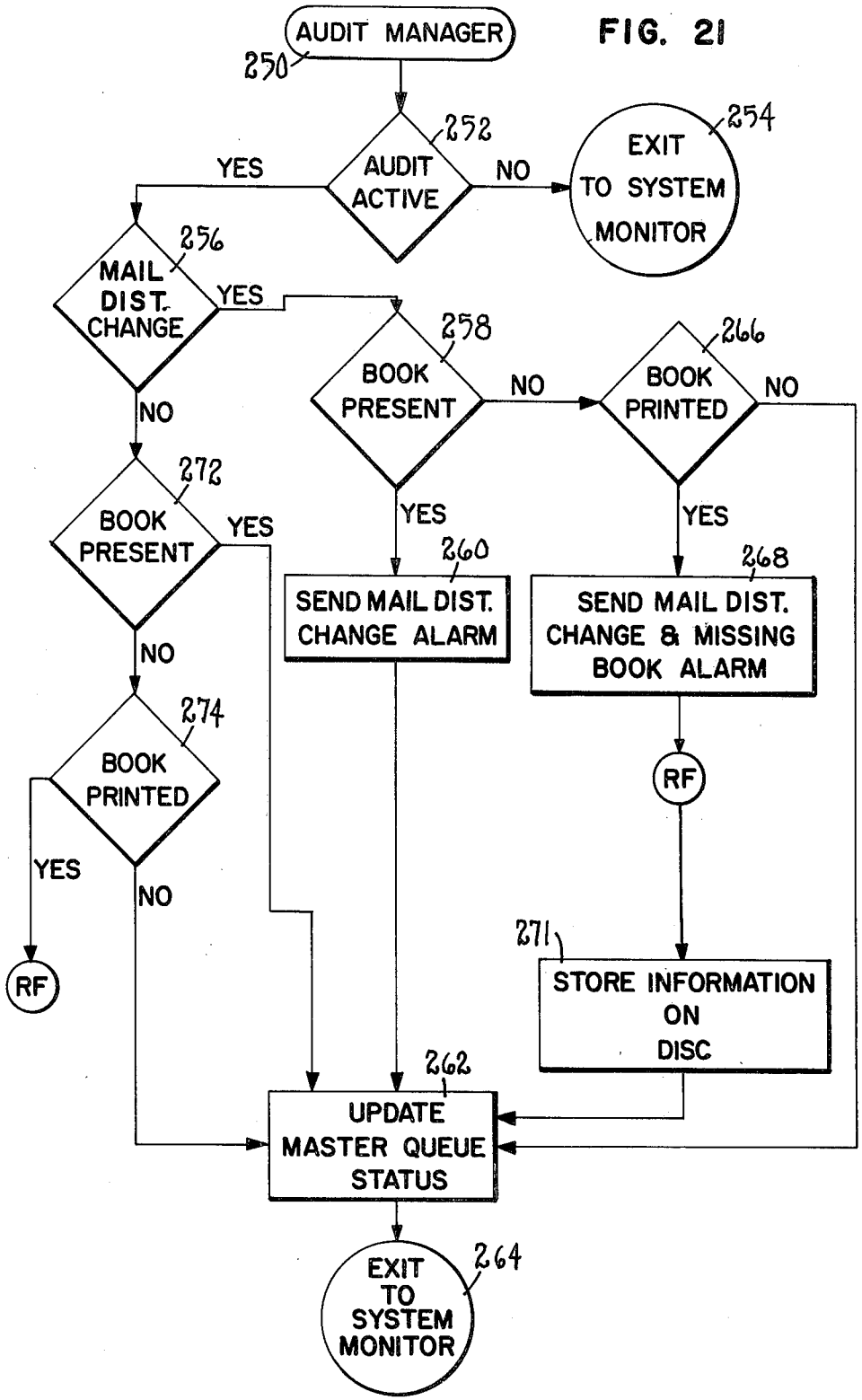
FIG. 21 is a logic flow chart for the audit manager program task.

The digital IO manager task as illustrated in FIGS. 20A and 20B monitors the status of the caliper 14, the lug detector 43, the leading edge detector 72, and the audit cell 24. The digital IO manager starts at block 200 and reads the digital IO status of the system devices at 202. A check is made at decision block 204 of whether an interrupt was received from the lug detector 43 indicating a lug 42 was detected passing the lug detector 43. If no lug is detected by the lug detector 43, at 210, as illustrated in FIG. 20B, a check is made on whether the leading edge 32 of a book of signatures 29 has been detected by the leading edge detector 72 at the print station 16. If a leading edge 32 is detected, at 211 a check is made to see if the caliper 14 indicated the book of signatures 29 had a proper number of pages 31, 33. If the book of signatures was found be of proper size, at 212 the print manager is informed that a leading edge is present. If the book of signatures 29 does not have a proper number of pages 31, 33, the print manager is not informed that a leading edge is present and thus the book of signatures 29 is not printed.

The I/O manager task is able to determine whether a book of signatures 29 has a proper number of pages 31, 33 due to the caliper 14 which notifies the computerized control system whether each book of signatures 29 has a proper number of pages 31, 33. As each book if signatures 29 passes the caliper 14, the caliper 14 via an interrupt informs the computerized control system if the book of signatures 29 has an improper number of book pages 31, 33. When the computerized control system is informed of a book of signatures 20 having an improper number of pages 31, 33, a location may be reserved in an area of core memory 102 referred to as a size queue 306. Each location in the size queue 306 includes a position field 308 as illustrated in FIG. 14. The position field 308 for each area of the size queue 306 reserved is incremented by one each time a lug 42 is detected by the lug detector 43. Thus the computerized control system monitors how far along the conveyor chain 12 each book of signatures 29 having an improper number of pages 31, 33, has advanced beyond the caliper 14. As noted earlier, one of the parameter entries made by the operator at system start-up is the number of lugs 42 between the caliper 14 and the leading edge detector 72.

Thus, for example, if the operator says there were five lugs 42 between the caliper 14 and the leading edge detector 72, when the position field 308 for a book of signatures 29 is incremented to a value of 5, the computerized control system knows that the book of signatures 29 having an improper number of pages 31, 33, is now at the leading edge detector 72. The computerized control system can then inhibit printing of that book of signatures 29 present at the printing station 16. The core memory 102 location for that particular book of signatures 29 is then removed from the size queue 306 as it is no longer required.

Regardless of whether a leading edge 32 is present, a check is made at 214 in FIG. 20B to see whether a book of signatures 29 has been detected by the audit cell 24. If a book of signatures 29 is detected as being present at 216, the audit manager is informed that a book of signatures 29 is present. At 218 an exit to the system monitor is performed whether or not a book of signatures 29 has been detected.

If back at decision 204 a lug 42 was detected, the position fields 303 and 308 in the master queue and size queue are updated at 224. A check is then made at 226 to see whether a leading edge 32 of a book of signatures 29 has been detected since the last lug 42 detection. If not, at 228 a no book condition at the print station 16 is indicated to the print manager. Regardless of the results of the check made above, a check is then made at 230 to determine whether or not a book of signatures 29 has been detected by the audit cell 24 since the last lug 42 detection. If not, a missing book of signatures 29 condition is indicated to the audit manager at 232 and at 233 an exit to the system monitor is performed. If a book of signatures 29 has been detected at 233, an exit to the system monitor at 233 is performed.

The audit manager task as illustrated in FIG. 18 starting at block 250, determines the action to be taken when a book of signatures 29 is present or absent at the audit cell 24 just prior to stacking for mailing. At block 252 a check is made to determine whether or not the audit cell is active. The operator indicates when the computer program is first started via parameter entry whether the audit cell 24 is to be utilized. If not, at 254 an exit to the system monitor is performed. At 256 a check is made for a mail distribution change. If a change in mail distribution is detected, at 258 a check is made for the presence of a book of signatures 29. If the book of signatures 29 is present, at 260 an alarm is sent to the alarm panel 92 indicating a mail distribution change and the presence of a book of signatures 29 so marked. At 262 the master queue 300 status is updated by removing the information for that book of signatures 29 from the master queue 300 and at 264 an exit to the system monitor is performed. If there was a mail distribution change and there is no book of signatures 29 present, at decision block 266 a check is made for whether a book of signatures 29 has been printed for that location. If not, steps 262 and 264 are performed. If a book of signatures 29 has been printed, at 268 an alarm is sent to the alarm panel 92 to indicate a mail distribution change condition with the signature book 29 marked with the mail distribution change mark missing. At 271 the information for the missing book of signatures 29 is stored on the disc cartridge 84. Steps 262 and 264 are then performed. If at 256 there was no mail distribution change, a check is made at 272 for whether a book of signatures 29 is present. If no book of signatures 29 is present, at 274 a check is made as to whether a book of signatures 29 had been printed for the location. If a book of signatures 29 had been printed but is now missing, steps 271, 262 and 264 are next performed so another book of signatures 29 can be reprinted. If a book of signatures 29 was not detected as being present and no book of signatures 29 had been printed for that location, steps 262 and 264 are performed. If a book of signatures 29 was detected as being present but there was no mail distribution change steps 262 and 264 are performed.

While various schematic diagrams of the computer program have been illustrated and described, it is to be understood that these have been utilized merely as a means to describe the possible logic function of a preferred embodiment of the present invention. Obviously, the logic functions can vary depending on how implemented and the nature of the computerized control system being used.

In operation, after the operator has initialized and started the system, the feeders 10 feed the signatures 30 onto the moving conveyor chain 12 so as to progressively build up the books or collections of signatures 29. Downstream from the feeders 10, the thicknesses of the books of signatures 29 are measured by the caliper 14. The caliper 14 detects variations in thickness which indicate a book of signatures 29 has an improper number of books pages 31, 33 or signatures 30. The caliper 14 notifies the diverter 20 and computerized control system of those books of signatures 29 which are determined to be faulty. When the faulty books of signatures 29 reach the diverter 20, they will be diverted to the rejector for rejection. The computerized control system upon receiving notice of a faulty book of signatures 29 will inhibit printing of subscriber information on that book of signatures 29 at the printing station 16.

After being measured by the caliper 14, the books of signatures 29 are conveyed downstream to the printing station 16. A leading edge detector 72 detects the approach of the books of signatures 29 and notifies the computerized control system of such. The computerized control system utilizes this information along with information from the shaft encoder 74 which monitors conveyor chain 12 movement to determine the proper indexing and spacing of characters to be printed. If the book of signatures 29 detected by the leading edge detector 72 was previously determined to have an improper number of book pages 31, 33, the computerized controls system inhibits printing of subscriber information on the book of signatures 29. The computerized control system will initiate printing on the next book of signatures 29 in sequence found to have a proper number of book pages 31, 33.

Note that the computerized control system does not require a complex program architecture for indexing and collation of mailing label information printed on the cover page 33 of a book of signatures 29 and customized information printed on the inside page 31 of a book of signatures 29. In the present system, since both types of information are printed near simultaneously, a simplified indexing scheme can be used.

After being printed, the bindings of the books of signatures 29 are stitched. Books of signatures 29 which were determined to be faulty by the caliper 14 are then diverted to the rejector 21 by the diverter 20. Those books of signatures 29 found to contain a proper number of book pages 31, 33 are next trimmed by the trimmer 22.

After the stitching and trimming is completed an audit cell 24 senses or detects the presence or absence of the books of signatures 29 on the conveyor chain 12 prior to stacking for mailing. The audit cell 24 informs the computerized system of the books of signatures 29 found to be missing. The computerized control system then determines the information which was printed on the missing books of signatures 29 and stores that information on cartridge disc 86. The audit cell 24 thus assures that all of the books of signatures 29, for whatever reason missing, are reprinted and delivered to their intended subscribers.

The computerized control system monitors the status of the signature printing process and generates alerts when the signature printing system is approaching an end of a book of signatures 29 run and is at the end of a run. In addition, while printing subscriber information on the books of signatures 29 at the printing station 16, the computerized control system monitors whether there is a change in the mail distribution. If so, the computerized control system causes a mail distribution change mark to be printed on the book of signatures 29 where the mail distribution change occurs. In addition, the computerized control system generates an alert if there is a mail distribution change and the audit cell 24 has detected the presence of a book of signatures 29 containing the mail distribution change mark or generates a different alert if there is a mail distribution change but the audit cell 24 has detected that the book of signatures 29 so marked with the mail distribution change mark is missing. These alerts or alarms will appear at the alarm panel 92 in the form of various indicator lights or audible alarms.

The present invention thus discloses a signature printing system capable of near simultaneous printing on two or more pages 31, 33, such as a cover page 33 and an inside page 31 of a book of signatures 29. Because of this and other features, the present invention assures that subscriber mailing label information will be properly coordinated with subscriber customized information printed on the inside of the books of signatures 29. In addition, because of the capability to print near simultaneously on the inside page 31 and cover page 33, the present invention requires a much less complicated control architecture.

It is to be understood, however, that even though these numerous characteristics and advantages of the invention have set forth in the foregoing description, together with details of the structure and function of the invention, the disclosure is illustrative only, and changes may be made in detail, especially in matters of shape, size, and arrangement of parts, within the principle of the invention, to the full extent indicated by the broad general meaning of the terms in which the appended claims are expressed.

What is claimed is:

1. A signature printing system for collating and printing signatures to form books of signatures having customized information printed on the inside thereof, said books having a plurality of inside pages and two cover pages, said signatures each having two centerfold pages and two outside pages, said signature printing system comprising:

(a) a collating conveyor for receiving said signatures so as to progressively build up books of said signatures, said conveyor conveying said signatures in a downstream direction;

(b) a plurality of feeders at stations spaced longitudinally along said collating conveyor for delivering said signatures to said conveyor in superpositioned relationship;

(c) means located adjacent said conveyor for selecting a signature from one of said feeders, said means extending downstream along said collating conveyor from said one feeder station;

(d) means located adjacent said conveyor downstream of said spaced stations and said selection means and operatively interconnected to said selection means to cooperate with said collating conveyor to move a page of said selected signature out of superpositioned relationship with a signature delivered to the conveyor just prior to the delivery of said selected signature and thereby open each book of signatures at said selected signature to expose an inside page of said book of signatures; and (e) signature printer means located adjacent said opening means for printing information on an inside page of said book of signatures when opened by said opening means.

2. A signature printing system in accordance with claim 1, wherein said opening means is constructed and arranged to cooperate with said collating conveyor to partition at said selected signature said pages of each book of signatures into first and second groups of pages, said first group of pages being left hanging in a substantially vertical first plane extending approximately radially from a line defined by path of travel of said collating conveyor past said opening means, said second group of pages being moved by said opening means into a second plane arcuately spaced from said first plane extending approximately radially from said line defined by said path of travel.

3. A signature printing system in accordance with claim 2, wherein said selection means includes an elongated guide member connected to said opening means, said guide member extending adjacent said collating conveyor upstream from said opening means to a location adjacent said one of said feeders, said guide member being positioned adjacent said one feeder such that said signatures delivered therefrom and from feeders downstream therefrom are delivered onto said collating conveyor over said guide member.

4. A signature printing system in accordance with claim 3, wherein said opening means comprises a plate-like member having an upstream end and a downstream end, said plate-like member being tapered in toward said collating conveyor at said upstream end to form a tapered plow portion for cooperating with said collating conveyor and said guide member to open each book of signatures at said selected signature so as to lift said second group of pages of each book of signatures into said second plane, said plate-like member having at said downstream end a platen for retaining said second group of pages in said second plane as said collating conveyor moves said pages over the surface thereof, said first group of pages remaining hanging in said first plane.

5. A signature printing system in accordance with claim 4, wherein said guide means includes a wire connected to said plow portion at said upstream end of said plate-like member, said wire being connected to said plate-like member at an edge adjacent said collating conveyor of said plate-like member to cooperate with said plow portion and said collating conveyor to open each of said books at said selected signature.

6. A signature printing system in accordance with claim 4, wherein said signature printer means comprises a dot matrix printer positioned adjacent said opening means for selectively printing dots in a matrix to form characters on said inside page of each book of signatures as said collating conveyor conveys each book of signatures past said opening means.

7. A signature printing system in accordance with claim 6, wherein said dot matrix printer comprises an ink jet printer mounted adjacent said opening means for projecting droplets of ink along a direction transverse to the direction of movement of said collating conveyor, whereby characters are printed on said inside page of each book of signatures as said collating conveyor conveys said signatures past said opening means.

8. A signature printing system in accordance with claim 6, wherein said plate-like member has an aperture therein, said dot matrix printer being positioned below said plate-like member in alignment with said aperture for printing on a centerfold page of said selected signature as said collating conveyor conveys said second group of pages over a top surface of said plate-like member, said centerfold page being positioned immediately adjacent the top surface of said plate-like member for printing of characters thereon by said dot matrix printer.

9. A signature printing system in accordance with claim 1 or 2, wherein said signature printer means comprises a first dot matrix printer positioned adjacent said opening means for selectively printing dots in a matrix to form characters on said inside page of each book of signatures as said collating conveyor conveys each book of signatures past said first dot matrix printer, and wherein a second dot matrix printer is positioned adjacent said opening means for selectively printing dots in a matrix to form characters on a cover page of each book of signatures as said collating conveyor conveys each book of signatures past said second dot matrix printer, said second dot matrix printer printing said outside cover page of each book of signatures substantially simultaneously as said inside page of each book of signatures is printed by said first dot matrix printers, said first and second dot matrix printers being located adjacent said opening means downstream of said feeders for printing said cover page and said inside page of each book of signatures after said signatures comprising said book of signatures have been delivered to said collating conveyor by said feeders.

10. A signature printing system in accordance with claim 4, wherein a plurality of plate-like members are fan mounted in a side-by-side arrangement adjacent said collating conveyor, said plate-like members having elongated guide members connected thereto and extending adjacent said collating conveyor upstream from said plate-like members to differing locations adjacent said feeders, such that different signatures are selected by said guide members from a plurality of feeders, said plate-like members cooperating with said guide members and said collating conveyor to open each book of signatures at a plurality of selected signatures as each book of signatures is conveyed past said plate-like members.

11. A signature printing system in accordance with claim 4, wherein a plurality of plate-like members are tandem mounted longitudinally adjacent said collating conveyor, said plate-like members having elongated guide members connected thereto and extending adjacent said collating conveyor upstream from said plate-like members to differing locations adjacent said feeders, such that different signatures are selected by said guide members from a plurality of feeders, said plate-like members cooperating with said guide members of said collating conveyor to open each book of signatures at a plurality of selected signatures as each book of signatures is conveyed past said plate-like members.

12. A signature printing system in accordance with claim 11, comprising sensing means located downstream of said signature printer means for sensing the presence of each book of signatures as each book of signatures moves past said sensing means, and wherein a control means is linked to said sensing means and said signature printer means, said control means cooperating with said sensing means and said signature printer means to reprint information which had been previously printed in said books of signatures determined to be missing by said sensing means.

13. A signature printing system in accordance with claim 12, wherein said sensing means comprises an audit photocell which is capable of detecting the presence of each book of signatures as each book of signatures passes in front thereof.

14. A signature printing system in accordance with claim 1, wherein said signature printer means is located downstream from said feeders and wherein a detection means is located adjacent said collating conveyor between said signature printer means and said feeders for cooperating with said collating conveyor to determine whether each book of signatures is complete, and wherein said signature printing system further comprises control means linked with said detection means and said signature printer means, said control means cooperating with said detection means and said signature printer means to prohibit printing of each book of signatures determined by said detection means not to be complete.

15. A signature printing system in accordance with claim 14, wherein said detection means comprises a caliper device for measuring the thickness of each book of signatures and comparing said measured thickness against a predetermined desired thickness to determine if each book of signatures has a proper number of pages.

16. A signature printing system in accordance with claim 1 or 6, wherein said signature printing system further comprises a storage means for storing said subscriber information to be printed on each book of signatures and a control means linked to said storage means and said signature printer means for transferring from said storage means to said signature printer means said subscriber information to be printed on each book of signatures.

17. A signature printing system for collating and printing signatures to form books of signatures having customized information printed on the inside thereof, said books having a plurality of inside pages and two cover pages, said signatures each having two centerfold pages and two outside pages, said signature printing system comprising:

(a) a collating conveyor for receiving said signatures so as to progressively build up books of said signatures, said conveyor conveying said signatures in a downstream direction;

(b) a plurality of feeders at stations spaced longitudinally along said collating conveyor for delivering said signatures to said conveyor in superpositioned relationship;

(c) means located adjacent said conveyor for selecting a signature from one of said feeders, said means extending downstream along said collating conveyor from said one feeder station;

(d) means located adjacent said conveyor downstream of said spaced stations and said selection means and operatively interconnected to said selection means to cooperate with said collating conveyor to move a page of said selected signature out of superpositioned relationship with a signature delivered to the conveyor just prior to the delivery of said selected signature and thereby open each book of signatures at said selected signature to expose an inside page of said book of signatures; and (e) signature printer means located adjacent said opening means including a first dot matrix printer positioned adjacent said opening means for selectively printing dots in a matrix to form characters on an inside page of each book of signatures as said collating conveyor conveys each book of signatures past said first dot matrix printer and a second dot matrix printer positioned adjacent said collating conveyor for selectively printing dots in a matrix to form characters on a cover page of each book of signatures as said collating conveyor conveys each book of signatures past said second dot matrix printer, whereby said cover page and said inside page of each book of signatures are printed substantially simultaneously as each book of signatures is conveyed past said first and second dot matrix printers.

18. A signature printing method for collating and printing signatures to form books of signatures having customized information printed on the inside thereof, said books having a plurality of inside pages and two cover pages, said signatures each having two centerfold pages and two outside pages, comprising the steps of:

(a) delivering said signatures onto a collating conveyor from a plurality of feeders at stations spaced longitudinally along said collating conveyor;

(b) conveying said signatures in a downstream direction past said feeders so as to progressively build up books of said signatures as said signatures are delivered onto said collating conveyor in superpositioned relationship;

(c) selecting a signature from one of said feeders;

(d) moving a page of said selected signature out of superpositioned relationship with a signature delivered to the conveyor just prior to the delivery of said selected signature thereby opening each book of signatures at said selected signature at a location downstream from said spaced stations to expose an inside page of said book of signatures; and (e) printing information on an inside page of each said book of signatures when opened.

19. A signature printing system method in accordance with claim 18, further comprising the step of measuring the thickness of each book of signatures prior to printing to determine whether said book of signatures has a proper number of signatures.

20. A signature printing method in accordance with claim 19, further comprising the step of inhibiting printing of information on each book of signatures determined to have an improper number of signatures.

21. A signature printing method in accordance with claim 20, further comprising the steps of detecting whether there is a change in mail distribution and printing of a mail distribution change indicator mark on a cover page of each book of signatures at said printing step when a change mail distribution is detected.

22. A signature printing method in accordance with claim 21, further comprising the steps of determining whether any books of signatures are missing after said printing step and reprinting at said printing step the information which had been previously printed in each book of signatures found to be missing.

23. A signature printing method in accordance with claim 22, wherein said printing step further includes printing on a cover page of each book of signatures such that said cover page and said inside page of each book of signatures is printed substantially simultaneously.

* * * * *

UNITED STATES PATENT AND TRADEMARK OFFICE

CERTIFICATE OF CORRECTION

PATENT NO. : 4,395,031

DATED : July 26, 1983

INVENTOR(S) : Gruber et al

It is certified that error appears in the above-identified patent and that said Letters Patent are hereby corrected as shown below:

Column 15, line 6 delete "if" and insert therefor --it--.

Column 15, line 58 delete "fun" and insert therefor --run--.

Column 16, line 27 between "," and "169" insert therefor --at--.

Signed and Sealed this

*Eighth* Day of *November 1983*

[SEAL]

*Attest:*

GERALD J. MOSSINGHOFF

*Attesting Officer*

*Commissioner of Patents and Trademarks*